US006489939B1

(12) United States Patent
Asao et al.

(10) Patent No.: US 6,489,939 B1
(45) **Date of Patent: *Dec. 3, 2002**

(54) METHOD FOR DRIVING PLASMA DISPLAY PANEL AND APPARATUS FOR DRIVING THE SAME

(75) Inventors: Shigeharu Asao; Noriaki Setoguchi; Yoshikazu Kanazawa, all of Kawasaki (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/261,961

(22) Filed: Mar. 3, 1999

(30) Foreign Application Priority Data

May 27, 1998 (JP) ..... 10-145844

(51) Int. Cl.[7] ..... G09G 3/28
(52) U.S. Cl. ..... 345/65; 345/60; 345/68
(58) Field of Search ..... 345/60, 62, 55, 345/65, 66, 68; 315/169.4, 169.3; 313/585, 586, 587

(56) References Cited

U.S. PATENT DOCUMENTS 5,227,900 A * 7/1993 Inaba et al. ..... 359/56
5,446,344 A 8/1995 Kanazawa ..... 315/169.4
5,790,087 A * 8/1998 Shigeta et al. ..... 345/67
5,963,184 A * 10/1999 Tokunaga et al. ..... 345/60
6,023,258 A * 2/2000 Kuriyama et al. ..... 345/60
6,037,916 A * 3/2000 Amemiya ..... 345/60

FOREIGN PATENT DOCUMENTS

| | | |
|---|---|---|
| EP | 0 549 275 | 6/1993 |
| EP | 0 657 861 | 6/1995 |
| EP | 0 762 373 | 3/1997 |
| JP | 2-220330 | 9/1990 |
| JP | 5-2993 | 1/1993 |
| JP | 7-160218 | 6/1995 |
| JP | 9-160525 | 6/1997 |
| JP | 10-207417 | 8/1998 |

* cited by examiner

*Primary Examiner*—Dennis-Doon Chow
(74) *Attorney, Agent, or Firm*—Staas & Halsey LLP

(57) ABSTRACT

A method for driving an interlace system plasma display panel comprising applying a pulse higher than a discharge start voltage at the end of a sustain discharge period for a period in which only a cell that has executed a sustain discharge and cells adjacent to the former cell start discharge, executing an erase discharge of the cell that has executed the sustain discharge, and at times, the cells adjacent to the former cell, and when a given field is switched over to another field, executing a similar discharge, i.e., the whole surface write operation and a self-erase discharge, of the cell that has executed display before the switch-over of the given field before the whole surface write operation and the self-erase discharge are effected in the cell that is to execute display after the switch-over of the given field. This driving method applies a pulse having an opposite polarity of the polarity of the whole surface write pulse for a period longer than the pulse width of the sustain discharge pulse. On the other hand, an apparatus for driving a plasma display panel by using the driving method is also disclosed.

34 Claims, 19 Drawing Sheets

REMARKS)
SECOND SUSTAIN VOLTAGE PULSES ARE APPLIED FOR EVERY SECOND DISPLAY LINE, AS IN X2, X4, X6, ···.

REMARKS)
SECOND SUSTAIN VOLTAGE PULSES ARE APPLIED FOR EVERY SECOND DISPLAY LINE, AS IN X2, X4, X6, ....

REMARKS)
SWITCHING DEVICES YSW4, YSW5 AND XSW3 OPERATE IN ADDRESSING PERIOD

METHOD FOR DRIVING PLASMA DISPLAY PANEL AND APPARATUS FOR DRIVING THE SAME

BACKGROUND OF THE INVENTION

1. Field of the Invention

The present invention relates to a technology for driving a display panel including a group of cells as display devices having a memory function, and more particularly to a method for driving a plasma display panel and an apparatus for driving the same which are directed to an improvement in the contrast of an alternating current (AC) type plasma display panel. (Generally, the whole plasma display apparatus inclusive of the plasma display panel and peripheral circuits is referred to as a "PDP".)

The AC type plasma display panel sustains discharge and carries out light emission display by alternately applying voltage waveforms of a plurality of pulses to two electrodes for sustaining this discharge. A discharge (lighting) operation for every discharge period finishes within a few microseconds ($\mu$s) after the application of pulses. The ions defined as positive electric charges that are generated by this discharge operation are accumulated over an insulating layer on the electrode to which a negative voltage is applied, and electrons defined as negative electric charges are similarly accumulated over an insulating layer on the electrode to which a positive voltage is applied.

Therefore, if wall charges are first generated by causing the discharge by the pulses (write pulses) each having a relatively high voltage (write voltage) and then the pluses (sustain discharge pulses, that is, sustain pulses) each having a voltage lower than that of each of the write pulses (sustain discharge voltage) and an opposite polarity to each of the write pulses are applied to the electrodes, electric charges generated by the sustain pulses are superimposed on the wall charges previously accumulated by the write pulses so as to enhance the accumulated wall charges. As a result, the potential of the wall charges with respect to a discharge space becomes large and, at least, the above voltage exceeds a discharge threshold voltage at which the discharge starts. In other words, given cells that once effected the write discharge and have formed the wall charges have the characteristics that these cells sustain the discharge when the sustain discharge pulses are alternately applied thereto in opposite polarities. A phenomenon having the above characteristics is referred to as a "memory effect" or "memory drive". The AC type plasma display panel carries out the display by utilizing this memory effect.

2. Description of the Related Art

The AC type plasma display panels can be classified into a two-electrode type which effects selective discharge (addressing discharge) and the sustain discharge by using two electrodes and a three-electrode type which effects addressing discharge by using a third electrode. In color plasma display panels for carrying out multi-gradation display, a phosphor inside the cells is excited by ultra-violet rays generated due to the discharge between different kinds of electrodes, but this phosphor involves the problem that it is extremely fragile against the impact of the ions defined as the positive charges that are generated simultaneously by the discharge. The former two-electrode type plasma display panel described above employs the construction in which the ions are allowed to collide directly with the phosphor and for this reason, the life of the phosphor is likely to become shortened. To avoid this problem, therefore, the latter three-electrode type plasma display panel utilizing a surface-discharge (that is, surface-discharge type plasma display panels) which is carried out between different electrodes that are located in the same plane, has been generally used in color plasma display panels.

Recently, an interlace system three-electrode type AC plasma display panel which is capable of providing a high definition display screen by reducing the pixel pitch (i.e., a space between adjoining cells) has recently attracted special attention. The method for driving the plasma display panel according to the prior art, etc, will be explained hereby with reference to FIGS. 1 to 9 that will be mentioned in the later-appearing "BRIEF DESCRIPTION OF THE DRAWINGS" in order to have the plasma display panel and its driving method according to the prior art more easily understood. The conventional method for driving the interlace system plasma display panel, etc, is typically described in Japanese Unexamined Patent Publication No. 9-160525 and No. 10-207417 corresponding to Japanese Patent Application No. 9-12700 filed on Jan. 27, 1997 by the same applicant (Fujitsu) as for the present invention. Such a driving method is referred to as the "Alis" (Alternate Lighting of Surfaces) method.

In a plasma display panel 10 having a schematic construction of a conventional surface-discharge type plasma display panel shown in FIG. 1, pixels are represented by dotted lines for only the display line (display row) L1. To simplify the explanation, the number of pixels of the plasma display panel 10 is assumed hereby as 6×8=48 in terms of the monochromatic pixels. Incidentally, the present invention can be applied to both color display and monochromatic display, and one pixel of the color display corresponds to three pixels of the monochromatic display.

In order to facilitate the production of the plasma display panel and to provide high definition by reducing the pixel pitch, the plasma display panel 10 employs the construction in which the partitions in the row direction are removed from the conventional plasma display panels. To prevent the occurrence of the erroneous discharge due to influences between the adjacent display lines resulting from the removal of the partition, interlace scanning is carried out so that the voltage waveforms of the sustain pulses have mutually opposite phases between the odd-numbered rows and the even-numbered rows of the electrodes for surface-discharge as will be described later.

In FIGS. 2 and 3, a perspective view showing the state in which the opposing gap between the color pixels 10*a* of the plasma display panel shown in FIG. 1 is expanded and a longitudinal sectional view along a sustain electrode X1 of the color pixel 10*a*, is illustrated, respectively.

In FIGS. 2 and 3, transparent electrodes 121 and 122 of an ITO film, or the like, are disposed in parallel with each other on one of the surfaces of a glass substrate 11, and metal electrodes 131 and 132 of copper (Cu), or the like, are formed along the center line on the transparent electrodes 121 and 122 in order to reduce the voltage drop in the longitudinal direction of the transparent electrodes 121 and 122, respectively. The transparent electrode 121 and the metal electrode 131 together constitute the sustain electrode X1 while the transparent electrode 122 and the metal electrode 132 together constitute the scan electrode Y1. A dielectric member 14 for retaining the wall charges is deposited on the glass substrate 11 and the electrodes X1 and Y1, and an MgO protective film 15 is further deposited on the dielectric member 14.

Address electrodes A1, A2 and A3 and partitions 171 to 173 for partitioning these address electrodes are formed on the surface of the glass substrate 16 that opposes the MgO protective film 15 in the direction orthogonally crossing the sustain electrode X1 and the sustain electrode Y1. These partitions define discharge cells (which are also referred to merely as the "cells" or "slits") in the regions where the addressing electrodes cross the sustain electrodes and the scan electrodes. A phosphor 181 emitting red light, a phosphor 182 emitting green light and a phosphor 183 emitting blue light when ultraviolet rays generated by the discharge are incident to them are deposited between the partitions 171 and 172, between the partitions 172 and 173 and between the partitions 173 and 174, respectively. A Ne+Xe Penning mixed gas, for example, is sealed into the discharge space between these phosphors 181 to 183 and the MgO protective film 15.

The partitions 171 to 174 function as spacers for preventing the ultra-violet rays generated by the discharge from being incident to the adjacent pixels and also for forming the discharge space. When the phosphors 181 to 183 are made of the same material, the plasma display panel 10 is a display panel for monochromatic display.

In an apparatus for driving a plasma display panel using the plasma display panel shown in FIG. 1, there are disposed a driving circuit for supplying a plurality of kinds of driving voltage pulses, that are necessary for writing predetermined display data to the selected cells, the sustain electrode, the scan electrode and the addressing electrode, and a control circuit for controlling the sequence of the supply of these driving voltage pulses. The driving circuit includes odd- and even-numbered X sustain circuits for supplying the write pulses and the sustain pulses to the sustain electrodes X1 to X5, odd- and even-numbered Y sustain circuits for supplying the scan pulses and the sustain pulses to the scan electrodes Y1 to Y4 and an addressing circuit for supplying the addressing pulses to the addressing electrodes A1 to A6.

In FIG. 4, a structural example of a frame for forming the color images of the plasma display panel shown in FIG. 1, is illustrated. In FIGS. 5A and 5B, a sequence of display scanning in the addressing period of the frame shown in FIG. 4, is illustrated.

The frame shown in FIG. 4 is divided into two fields, that is, an odd-numbered field and an even-numbered field. Each field comprises first to third subfields. In each sub-field of the odd-numbered field, the voltage having the waveform shown in the later-appearing FIG. 6 is supplied to each electrode of the plasma display panel 10 so as to cause the display lines L1, L3, L5 and L7 to display, and in each sub-field of the even-numbered field, the voltage having the waveform shown in the later-appearing FIG. 7 is supplied so as to enable the display lines L2, L4, L6 and L8 shown in FIG. 1 to display. The sustain discharge periods in the first to third sub-fields are T1, 2T2 and 4T1, respectively, and the sustain discharge is effected a number of times proportional to the length of the period in each sub-field. Consequently, the luminance has 8 (eight) kinds of gradations. Similarly, when the number of the sub-fields is 8 and the ratio of the sustain discharge periods is 1:2:4:8:16:32:64:128, the luminance has 256 kinds of gradations.

Scanning of the display lines in the addressing period is carried out in the number of sequence inside the white circle ○ in FIG. 5A. In other words, the display lines are scanned in the sequence of L1, L3, L5 and L7 in the odd-numbered fields, and are scanned in the sequence of L2, L4, L6 and L8 in the even-numbered fields. Further, to reduce power consumption in the addressing period, it is possible to further divide each of the display lines L1, L3, L5 and L7 inside the odd-numbered fields into odd-numbered rows and even-numbered rows, and to scan serially one of these rows first and then to scan the other, as shown in FIG. 5B. This also holds true of the even-numbered fields.

In FIG. 6, the waveforms of the voltages applied to the electrodes in the odd-numbered fields in the first example of a conventional method for driving the plasma display panel, is illustrated. In FIG. 7, the waveforms of the voltages applied to the electrode in the even-numbered fields in the first example of the conventional method for driving the plasma display panel. Though the odd-numbered field and the even-numbered field have a plurality of sub-fields having mutually different sustain discharge periods in practice as shown in FIG. 4, the drawings show only one sub-field to simplify the related explanation.

First, a series of operations in the odd-numbered field will be explained with reference to FIG. 6. Symbols W, E, A and S in FIG. 6 represent the points of time in which the whole surface write discharge for all the cells, the whole surface self-erase discharge for all the cells, the addressing discharge and the sustain discharge occur, respectively. To simplify the explanation, the electrodes will be generically called as follows.

Sustain electrode (i.e. X electrode): electrodes X1 to X5 Odd-numbered sustain electrode: electrodes X1, X3 and X5 Even-numbered sustain electrode: electrodes X2 and X4 Scan electrode (i.e. Y electrode): electrodes Y1 to Y4 Odd-numbered scan electrode: electrodes Y1 and Y3 Even-numbered scan electrode: electrodes Y2 and Y4 Addressing electrode: addressing electrodes A1 to A6

On the other hand, symbols have the following meaning.

Vfxy: discharge start voltage between adjacent sustain electrode and scan electrode Vfay: discharge start voltage between opposed addressing electrode and scan electrode Vwall: voltage between positive wall charges and negative wall charges (wall voltage) due to wall charges generated by discharge between the adjacent sustain electrode and scan electrode Typically, Vfxy=290V and Vfay=180V. Further, the voltage between the addressing electrode and the sustain electrodes is abbreviated as the voltage between the A–X electrodes and the voltage between the addressing electrode and the scan electrodes is abbreviated as the voltage between A–Y electrodes. Similar abbreviation will be used between other electrodes, too.

(1) Reset period

During the reset period, the voltage waveforms supplied to the sustain electrodes are the full surface write pulse (which is generally called the "write pulse") and are mutually the same, the voltage waveforms supplied to the scan electrodes are 0V and are mutually the same, and the voltage waveforms supplied to the addressing electrodes are an intermediate voltage pulse and are mutually the same.

First, the applied voltage of each electrode is 0V. The positive wall charge exists on the lighting cells (pixels), that is, the MgO protective film 15 of the display slit on the sustain electrode side and the negative wall charge exists on the side of the scan electrodes (that is, the wall charges of the positive polarity remains) due to the last sustain pulse of the previous sustain discharge period of the reset period. The wall charges hardly exist on the side of the sustain electrode and on the side of the scan electrode of the cells which are in a lights-out state (i.e., an off state), that is, non-display slits.

The reset discharge pulse having a voltage Vw (that is, the write pulse) is supplied to the sustain electrode and an intermediate voltage pulse having a voltage Vaw is supplied to the addressing electrode during the period a≦t≦b. For example, Vw=310V and Vw>Vfxy. The whole surface write discharge for all the cells W (which is also called "all cell write discharge" because the above write discharge is effected for all the cells irrespective of the lighting cells and the lights-out cells) between the adjacent X–Y electrodes, that is, between the X–Y electrodes of the display lines L1 to L8 irrespective of the existence of the wall charges. The wall charges having the opposite polarity (that is, the negative wall charges) occur as the resulting electrons and positive ions are extracted by the electric field due to the X–Y electrode voltage Vw, so that the field intensity of the discharge space decreases and the discharge finishes within one to several micro-seconds (μs). Because the voltage Vaw is approximately Vw/2 and also because the voltage between the A–X electrodes and the voltage between the A–Y electrodes have mutually opposite phases but have a substantially equal absolute value, the average of the wall charges adhered to the phosphor by the discharge is substantially zero (0).

When the reset discharge pulse falls at t=b, that is, when the applied voltage having the opposite polarity to the wall voltage disappears, the wall voltage Vwall between the X–Y electrodes becomes larger than the discharge start voltage Vfxy, and the whole surface self-erase discharge E (which is also called "all cell self-erase discharge) occurs. In this instance, since the voltages of the sustain electrode, the scan electrode and the addressing electrode are 0V, it would be ideal that the wall charge is hardly generated by this whole surface self-erase discharge and the ions and the electrons are recombined with each other inside the discharge space to thereby accomplish complete neutralization. In practice, however, all the wall charges are not always neutralized completely in the whole surface self-erase discharge and a small amount of the wall charges having the negative polarity remain in the cells.

(2) Addressing period

In the addressing period, the voltage waveforms supplied to the odd-numbered sustain electrodes are mutually the same and the voltage waveforms supplied to the even-numbered sustain electrodes are mutually the same. Further, the voltage waveforms supplied to the non-selected scan electrodes are a voltage −Vsc and are mutually the same. The scan electrodes are selected in the order of Y1 to Y4, and a scan pulse having a voltage −Vy (that is, a scan pulse) is supplied to the selected scan electrodes while the non-selected scan electrodes are set to a voltage −Vsc. For example, Vsc=Va−50V and Vy 4−150V.

In the condition (c≦t≦d), the scan pulse of the voltage −Vy is supplied to the scan electrode Y1, and the addressing pulse of a voltage Va is supplied to the addressing electrodes of the cells required to be turned on. In this case, the relation Va+Vy>Vfay is established, and the addressing discharge occurs for only the cells required to be turned on, the wall charges having the opposite polarity occurs and the discharge finishes. At the time of this addressing discharge, the pulse of the voltage Vx is supplied to only the electrode X1 among the electrodes X1 and X2 adjacent to the electrode Y1. When the discharge start voltage between the X–Y electrodes triggered by this addressing discharge is Vxyt, the following relation is established:

$$Vx+Vsc<Vxyt<Vx+Vy<Vfxy$$

The write discharge occurs between the X1–Y1 electrodes of the display line L1 and the wall charges of the opposite polarity, to an extent such that self discharge does not occur, are generated between the X1–Y1 electrodes and the discharge finishes. On the other hand, no discharge develops between the X2–Y2 electrodes of the display line L2.

In the condition (d≦t≦e), the scan pulse of a voltage of −Vy is supplied to the electrode Y2, the pulse of the voltage Vx is supplied to the even-numbered sustain electrodes and the address pulse of the voltage Va is supplied to the addressing electrodes for the cells required to be turned on. Similarly, the write discharge occurs between the X2–Y2 electrodes of the display line L3, the wall charges of the opposite polarity are generated but no discharge develops between the X3–Y2 electrodes of the display line L4.

An operation similar to the above is thereafter executed in the same way at e≦t≦g.

The write discharge of the display data develops for the cells required to be turned on in the order of the display lines L1, L3, L5 and L7 and the positive wall charges are generated on the side of the scan electrode while the negative wall charges are generated on the side of the sustain electrode. In other words, the positive wall charges are generated in the selected cells (display slits) but no wall charges are generated in the non-selected cells (non-display cells).

(3) Sustain discharge period

A series of sustain pulses having the same phase and the same voltage Vs are supplied to the odd-numbered sustain electrodes and to the even-numbered scan electrodes during the sustain discharge period, and a series of sustain pulses having a phase deviated by 180° (½ cycle) from the former series are supplied to the even-numbered sustain electrodes and to the odd-numbered scan electrodes. On the other hand, the voltage Ve is supplied to the addressing electrodes in synchronism with the rising edge of the first sustain pulse and is held until the sustain discharge period is completed.

In the condition (h>t>p), the sustain pulse of the voltage Vs is supplied to the odd-numbered scan electrodes and the even-numbered sustain electrodes. The effective voltage of the cells between the odd-numbered electrodes Y and the odd-numbered electrodes X is Vs+Vwall, and the effective cell voltage between the even-numbered X–Y electrodes is Vs−Vwall. Further, the effective cell voltages between the odd-numbered X and even-numbered scan electrodes and between the even-numbered X and odd-numbered scan electrodes are 2Vwall, respectively. In this case, the following relation is established:

$$Vs<Vfxy<Vs+Vwall,\ 2Vwall<Vfxy$$

The sustain discharge occurs between the odd-numbered Y electrodes and the odd-numbered X electrodes, the wall charges of the opposite polarity develop and the discharge finishes. No sustain discharge occurs between other electrodes. Therefore, the display is effective in only the odd-numbered display lines L1 and L5 inside the odd-numbered fields. The sustain discharge does not occur only this first time between the even-numbered Y electrodes and the even-numbered X electrodes.

In the condition (q≦t≦r), the sustain pulse of the voltage Vs is supplied to the odd-numbered sustain electrodes and to the even-numbered scan electrodes. The effective voltages of the cells between the odd-numbered X and odd-numbered Y electrodes and between the even-numbered Y and even-numbered x electrodes are all Vs+Vwall, and the effective voltages between the odd-numbered Y and even-numbered X electrodes and between the odd-numbered X and even-numbered Y electrodes are zero. Consequently, the sustain discharge occurs between the odd-numbered X and odd-numbered Y electrodes and between the even-numbered Y and even-numbered X electrodes, and the wall charges having the opposite polarity occur, so that the discharge finishes. Therefore, display of all the odd-numbered display lines L1, L3, L5 and L7 of the odd-numbered fields becomes simultaneously effective.

Thereafter, the sustain discharge is repeated in the same way. In this case, as is obvious from the wall charges shown in FIG. 6, the effective voltages of the cells between the odd-numbered Y and even-numbered X electrodes of the non-display lines and between the odd-numbered X and even-numbered Y electrodes become zero. The last sustain discharge of the sustain discharge period is effected so that the polarity of the wall charges can return to the original state.

Next, the operation in the even-numbered fields will be explained. In FIG. 7, display of the display lines L1, L3, L5 and L7 of the pairs of the scan electrodes Y1 to Y4, and the sustain electrodes X1 to X4 respectively adjacent to the above scan electrodes in the upper positions, becomes effective in the odd-numbered fields as described above. In the even-numbered fields, display of the display lines L2, L4, L6 and L8 of the pairs of the electrodes Y1 to Y4, and the electrodes X2 to X5 respectively adjacent to the above scan electrode in the lower positions, may be effected. This can be accomplished by reversing the role of the electrode X1 and the electrode X2 for the electrode Y1, reversing the role of the electrode X2 and the electrode X3 for the electrode Y2, and so forth. In other words, the voltage waveforms supplied to the odd-numbered sustain electrodes and the even-numbered sustain electrodes that are grouped may be replaced with each other. FIG. 7 shows the waveforms of the voltages applied to the electrode in the even-numbered fields.

The operation in the even-numbered fields is obvious from the explanation given above and from FIG. 7. Generally speaking, the whole surface write discharge W and the whole surface self-erase discharge E are carried out in the reset period, the electrodes Y1 to Y4 are serially selected and the write discharge of the display data is effected in the order of the display lines L2, L4, L6 and L8 in the addressing period, and the simultaneous sustain discharge of these display lines L2, L4, L6 and L8 is repeated in the sustain discharge period.

Referring further to FIGS. 6 and 7, power consumption can be reduced if the number of pulses can be reduced. The number of pulses can be reduced if the pulses supplied to the odd-numbered sustain electrodes and the even-numbered sustain electrodes are rendered continuous during the addressing period. This can be accomplished by employing the arrangement shown in FIG. 5(B) for the scanning sequence. In other words, the display lines L1, L3, L5 and L7 inside the odd-numbered fields are further divided into the odd-numbered rows and the even-numbered rows, and after one of them is serially scanned, the other may be scanned. This also holds true of the even-numbered fields.

In the first example of the conventional interlace system plasma display panel driving method described above, the whole surface write discharge and the self-erase discharge are carried out every time in the reset period of each sub-frame and are not dependent on whether or not the sustain discharge is effected in the sustain discharge period immediately before this period. Therefore, background light emission becomes unnecessarily large and the contrast ratio is likely to decrease.

In FIGS. 8 and 9, timing charts useful for explaining the second example of a conventional interlace system plasma display driving method worked out in consideration of the problem described above, are illustrated.

FIGS. 8 and 9 show the waveforms of one frame comprising the odd-numbered fields and the even-numbered fields. Though the odd-numbered field and the even-numbered field have, in practice, a plurality of sub-fields having mutually different sustain discharge periods as shown in FIG. 4, the drawings show only one sub-field to simplify the illustration.

Each sub-field has the reset period, the addressing period and the sustain discharge period as shown in the drawings. When the immediately previous sub-field finishes, the wall charge corresponding to the display of this sub-field remains, and the reset discharge is conducted in the reset period at the start of the next sub-field. This reset discharge is a strong discharge which is generated by applying a voltage exceeding the discharge start voltage between the sustain electrode Xi (where i is a given natural number) and the scan electrode Yn (where n is a given natural number), and makes uniform the charge distribution of each discharge cell irrespective of the discharge state in the immediately previous sub-field. The second example of the prior art sets the potential of each electrode to a level exceeding the discharge start voltage for the display slits and to a level less than the discharge start voltage for the non-display slits.

To begin with, the operation in the odd-numbered fields shown in FIGS. 8 and 9 will be explained. In the odd-numbered field, the positive pulse Vs is applied to the odd-numbered sustain electrodes X1, X3, . . . , X2i−1 (where i is a given natural number) and a negative pulse −Vu is applied to the odd-numbered scan electrodes Y1, Y2, . . . , Y2n−1 (where n is a given natural number). At the same time, the negative pulse −Vu is applied to the even-numbered sustain electrodes X2, X4, . . . , X2I whereas the positive pulse Vs is applied to the Y2, Y4, . . . , Y2n. As a result, the potential difference between the odd-numbered sustain electrodes and the scan electrodes X1−Y1, X3−Y3, . . . , X2i−1−Y2n−1 as the display slits in the odd-numbered field and the even-numbered sustain electrodes and scan electrodes X2−Y2, X4−Y4, . . . , X2i−I−Y2n become Vs+Vu. When this potential difference Vs+Vu is set to a potential higher than the discharge start voltage between the electrodes, the reset discharge is effected in each display slit. On the other hand, the potential difference between the odd-numbered scan electrodes and the even-numbered sustain electrodes as the non-display slits in the odd-numbered fields, i.e. Y1−X2, Y3−X4, . . . , Y2n−1−X2i is zero, and no discharge occurs. Therefore, in the second conventional example described above, the reset discharge is effected in only the display slits.

Incidentally, it has been customary to apply the pulse Vaw to the addressing electrodes with the application of the whole surface write pulse, but the application of this pulse Vaw becomes unnecessary, because the voltage applied to each sustain electrode and to each scan electrode becomes lower than in the prior art and a possibility of the occurrence of the discharge with the addressing electrodes does not exist.

Due to the reset discharge described above, the wall charges having the mutually opposite polarities are accumulated in excess on both the sustain electrode and the scan electrode. Therefore, the self-erase discharge occurs due to the wall charges themselves by setting the potentials of both electrodes to an equal voltage or more concretely, by setting both electrodes to the ground potential, to thereby neutralize the wall charges.

In the subsequent addressing period, the write discharge corresponding to the input data, that in turn corresponds to the display data, is effected. Here, a method is employed which first executes the write operation of the odd-numbered electrodes and then executes the write operation of the even-numbered electrodes. In other words, the scan pulse −Vy is serially applied to the odd-numbered electrodes Y1, Y3, . . . , Y2n−1. Incidentally, the base pulse −Vsc is applied to each scan electrode Yn during the addressing period, and the scan pulse −Vy is superposed with the base pulse −Vsc. The addressing pulse Va is selectively applied to the addressing electrode Aj (where j is a given natural number) in accordance with the input signal, and the discharge is effected between this addressing electrode and the scan electrode Y2n−1 to which the scan pulse −Vy is applied. In this instance, since the pulse Vx is applied to only the odd-numbered sustain electrodes X1, X3, . . . , X2i−1 in the odd-numbered fields, the write discharge is effected only between the odd-numbered sustain electrodes and scan electrodes X1–Y1, X3–Y3, X2i−1–Y2n−1, and the wall charges are built up on both electrodes. Next, the scan pulse −Vy is serially applied to the even-numbered scan electrodes Y2, Y4, . . . , Y2n. Similarly, the data pulse Va is selectively applied to the addressing electrodes Aj and the pulse Vx is applied this time to only the even-numbered sustain electrodes X2, X4, . . . , X2i. Consequently, the discharge is effected between only the even-numbered sustain electrodes and scan electrodes X2–Y2, X4–Y4, . . . , X2i–Y2n, and the wall charges are accumulated on both electrodes.

In the subsequent sustain discharge period, the sustain discharge pulse Vs is alternately applied to the sustain electrodes Xi and the scan electrodes Yn constituting the display slits, so that the sustain discharge is executed in the discharge cells in which the write discharge is effected. In this instance, the voltage pulse having the same phase is applied to the sustain electrodes and the scan electrodes constituting the non-display slits lest the discharge occurs between the sustain electrodes and the scan electrodes constituting the non-display slits. In other words, the sustain discharge pulse is alternately applied in the odd-numbered fields between the odd-numbered sustain electrodes and scan electrodes X1–Y1, X3–Y3, . . . , X2i−1–Y2n−1 and between the even-numbered sustain electrodes and scan electrodes X2–Y2, X4–Y4, . . . , X2i–Y2n constituting the display slits, but this pulse has the same phase between the odd-numbered scan electrodes and the even-numbered sustain electrodes Y1–X2, Y3–X4, . . . , Y2n−1–X2i and between the even-numbered scan electrodes and the odd-numbered sustain electrodes Y2–X3, Y4–X5, . . . , Y2n–X2i−1 constituting the non-display slits.

Next, in the even-numbered fields, the display slits are so changed as to be positioned between the odd-numbered scan electrodes and the even-numbered sustain electrodes Y1–X2, Y3–X4, . . . , Y2n−1–X2i and between the even-numbered scan electrodes and the odd-numbered sustain electrodes Y2–X3, Y4–X5, Y2n–X2i−1. The impressed voltage to each display slit is the same as that of the odd-numbered field. In other words, the positive pulse Vs is applied this time to the odd-numbered scan electrodes Y1, Y3, . . . , Y2n−1 while the negative pulse −Vu is applied to the even-numbered sustain electrodes X2, X4, . . . , X2i. At the same time, the negative pulse −Vu is applied to the even-numbered scan electrodes Y2, Y4, . . . , Y2n while the positive pulse Vs is applied to the odd-numbered sustain electrodes X1, X3, . . . , X2 i−1. In consequence, the voltage differences between the odd-numbered scan electrodes and the even-numbered sustain elctrodes Y1–X2, Y3–X4, . . . , Y2n−1–X2i and between the even-numbered scan electrodes and the odd-numbered sustain electrodes Y2–X3, Y4–X5, . . . , Y2n–X2i−1 as the display slits in the even-numbered fields become Vs+Vu that exceeds the discharge start voltage between these electrodes, and the reset discharge is executed in each display slit.

On the other hand, the potential difference between the odd-numbered sustain electrodes and scan electrodes X1–Y1, X3–Y3, . . . , X2−1–Y2n−1 and the even-numbered sustain electrodes and scan electrodes X2–Y2, X4–Y4, . . . , X2–Y2n as the non-display slits in the even-numbered fields are both zero and no discharge occurs. Therefore, the reset discharge is executed in only the display slits. After this reset discharge is completed, the self extinction discharge occurs in the same way as in the odd-numbered fields, and the wall charges generated by the reset discharge are neutralized.

In the subsequent addressing period, too, the driving sequence is executed in the same way as in the odd-numbered fields described above with the exception that the display slits are changed. Therefore, the detailed explanation of the driving sequence in the addressing period in the even-numbered fields will be hereby omitted.

In the subsequent sustain discharge period, too, the sustain discharge pulse Vs is alternately applied to the sustain electrodes and the scan electrodes constituting the display slits in the same way as in the case of the odd-numbered fields described above, and the sustain discharge is executed in the discharge cells in which the write discharge is effected. Therefore, the detailed explanation of the driving sequence in the sustain discharge period in the even-numbered fields, too, will be hereby omitted.

As described above, according to the first example of the conventional driving method of the interlace system plasma display panel, the full surface write discharge and the self-erase discharge are executed every time for all the slits during the reset period of each sub-frame irrespective of the display slits (that is, the slits between the sustain electrodes that have executed the sustain discharge and the scan electrodes) and the non-display slits (that is, the slits between the sustain electrodes that have not executed the sustain discharge and the scan electrodes). Therefore, background light emission becomes larger than necessary level and the contrast ratio decreases, accompanied by the deterioration of display quality. Further, according to the second example of the conventional driving method of the interlace system plasma display panel, the voltage of the reset discharge pulse is so set as to exceed the discharge start voltage by only the display slits. Therefore, the decrease in the contrast ratio due to the unnecessary reset discharge in the non-display slits can be avoided.

However, even when the second example of the conventional plasma display panel driving method is employed, there is no alteration in that the whole surface write discharge and the self-erase discharge are executed every time in the reset period of each sub-frame and for this reason, a drastic improvement in the contrast ratio cannot be expected.

SUMMARY OF THE INVENTION

In view of the problems described above, it is an object of the present invention to provide a method for driving a plasma display panel, and an apparatus for driving the same, which can improve display quality by improving a contrast ratio of a display screen of a plasma display panel, and can guarantee a stable discharge of a next field when a given field is changed to another field.

When driving a plasma display panel comprising a plurality of sustain electrodes and a plurality of scan electrodes disposed in parallel with each other on a substrate for each display line; a plurality of addressing electrodes isolated electrically from the sustain electrodes and the scan electrodes and disposed in so as to cross the sustain electrodes and the scan electrodes; and discharge cells formed in areas in which the addressing electrodes cross the sustain electrodes and the scan electrodes, a method for driving a plasma display panel according to the present invention includes odd-numbered fields for carrying out display between odd-numbered sustain electrodes and odd-numbered scan electrodes and between even-numbered sustain electrodes and even-numbered scan electrodes, and even-numbered fields for carrying out display between the odd-numbered sustain electrodes and the even-numbered scan electrodes and between the even-numbered sustain electrodes and the odd-numbered scan electrodes.

Further, in the driving method described above, each of the odd-numbered and even-numbered fields includes a reset period for applying a predetermined voltage to the sustain electrode, the scan electrode and the addressing electrode and executing a reset discharge in a plurality of discharge cells in order to make uniform a charge distribution among a plurality of discharge cells uniform; an addressing period for executing a write discharge between the scan electrode and the addressing electrode in a selected one of discharge cell and executing a selective write operation in accordance with display data; and a sustain discharge period for applying alternately a sustain discharge pulse to the sustain electrode and the scan electrode in order to repeatedly execute discharge light emission for displaying the display data in the discharge cell in which the selective write operation is executed in the addressing period.

In the driving method of the plasma display panel described above, a reset discharge pulse having a voltage higher than a discharge start voltage necessary for starting the reset discharge is applied in the reset period to the sustain electrode and the scan electrode for the period in which the discharge is started in the discharge cell that has executed the sustain discharge and the discharge cells adjacent to the former discharge cell, and then the potential difference between the sustain electrode and the scan electrode is made substantially zero so that an erase discharge can be done for the cells that have executed the sustain discharge.

Preferably, in the driving method according to the present invention, the time for applying the reset discharge pulse having a voltage higher than the discharge start voltage is set to a value not larger than 2 $\mu$s.

Preferably, further, in the driving method according to the present invention, an auxiliary erase pulse having a gentle slope is applied to the sustain electrode or the scan electrode after the passage of the period in which the potential difference between the sustain electrode and the scan electrode is made substantially zero.

Preferably, further, in the driving method according to the present invention, the auxiliary erase pulse described above is set to a pulse having a polarity opposite to that of the reset discharge pulse having a voltage higher than the discharge start voltage.

Preferably, further, in the driving method according to the present invention, the auxiliary erase pulse is a pulse having the opposite polarity to that of the voltage pulse having a voltage higher than the discharge start voltage.

Preferably, further, in the driving method of the present invention, the auxiliary erase pulse is a pulse having the same polarity as that of the pulse having a voltage higher than the discharge start voltage, and is applied to the sustain electrode or scan electrode different from the electrode to which the reset discharge pulse having a voltage higher than the discharge start voltage is applied.

Preferably, further, in the driving method of the present invention, the reset discharge pulse having a voltage higher than the discharge start voltage is applied to either one of the sustain electrode and the scan electrode.

Preferably, further, in the driving method according to the present invasion, the reset discharge pulses having a voltage higher than the discharge start voltage are applied at the same timing.

Preferably, further, in the driving method according to the present invention, a first sustain voltage pulse, which has an opposite polarity to that of the reset discharge pulse having a voltage higher than the discharge start voltage and has a width larger than that of the sustain discharge pulse described above, is applied before the reset discharge pulse having a voltage higher than the discharge start voltage is applied.

Preferably, further, in the driving method according to the present invention, a second sustain voltage pulse having a width larger than that of the sustain discharge pulse is applied for every other display line between the sustain discharge period and the first sustain voltage pulse applied before the application of the reset discharge pulse having a voltage higher than the discharge start voltage.

In the driving method according to the present invention, further, each of the odd- and even-numbered fields includes a reset period in which a predetermined voltage is applied to the sustain electrode, the scan electrode and the addressing electrode in order to make uniform the charge distribution among a plurality of discharge cells and to execute the reset discharge in each of a plurality of discharge cells; an addressing period in which the write discharge is executed in the selected discharge cell between the scan electrode and the addressing electrode and the selective write operation is made in accordance with the display data; and a sustain discharge period in which the sustain discharge pulse is alternately applied to the sustain electrode and the scan electrode in order to repeatedly execute discharge light emission for displaying the display data in the discharge cell in which the selective write operation is made in the addressing period.

When the odd-numbered field and the even-numbered field are switched over to each other, a reset process is executed so that the whole surface write discharge is executed by applying the reset discharge pulse having a voltage higher than the discharge start voltage to the pair of the sustain electrode and the scan electrode, that has executed, or is to execute, the sustain discharge and the self-erase discharge is effected at the point of time in which the reset discharge pulse having a voltage higher than the discharge start voltage is eliminated, and after this reset process is executed, another reset process is executed so that a voltage having the opposite polarity to that of the voltage of the whole surface write discharge and approximate to the sustain discharge pulse is applied for a period larger than the width of the sustain discharge pulse and furthermore, the reset discharge pulse having a voltage higher than the discharge start voltage is applied in the pair of the sustain electrode and the scan electrode that is to effect the sustain discharge in the next odd-numbered field or even-numbered field to thereby execute the whole surface write discharge, and the self-erase discharge is executed at the point of time in which the reset discharge pulse having a voltage higher than the discharge start voltage is eliminated.

Preferably, in the driving method according to the present invention, after the reset process described above is executed for the pair of the sustain electrode and the scan electrode of either one of the odd-numbered and even-numbered display lines among the pairs of the sustain electrodes and the scan electrodes that have executed, or are to execute, the sustain discharge, the reset process is executed for the other pair of the sustain electrode and the scan electrode, the voltage having the opposite polarity to that of the whole surface write discharge in the reset process described above and approximate to the voltage of the sustain discharge pulse is applied for a period at least equal to the pulse width of the sustain discharge pulse, the reset process is further applied to the pair of the sustain electrode and the scan electrode of either one of the odd-numbered and even-numbered display lines in the next odd-numbered field or the next even-numbered field, and then the reset process is executed for the other pair of the sustain electrode and the scan electrode.

On the other hand, in a plasma display panel including a plurality of sustain electrodes and a plurality of scan electrodes disposed in parallel with each other for each display line on a substrate, a plurality of addressing electrodes electrically isolated from the sustain electrodes and the scan electrodes and disposed so as to cross the sustain electrodes and the scan electrodes and discharge cells formed in areas in which the addressing electrodes cross the sustain electrodes and the scan electrodes, respectively, an apparatus for driving a plasma display panel according to the present invention includes odd-numbered fields for carrying out display between odd-numbered sustain electrodes and odd-numbered scan electrodes and between even-numbered sustain electrodes and even-numbered scan electrodes, respectively, and even-numbered fields for carrying out display between the odd-numbered sustain electrodes and the even-numbered scan electrodes and between the even-numbered sustain electrodes and the odd-numbered scan electrodes, respectively.

In the driving apparatus described above, each of the odd-numbered and even-numbered fields includes a reset period for executing a reset discharge inside a plurality of discharge cells by applying a predetermined voltage to the sustain electrodes, the scan electrodes and the addressing electrodes in order to make uniform the charge distribution among a plurality of discharge cells; an addressing period in which a write discharge is effected between the scan electrode and the addressing electrode in a selected discharge cell, and executing a selective write operation; and a sustain discharge period in which a sustain discharge pulse is alternately applied to the sustain electrode and the scan electrode in order to repeatedly execute discharge light emission for displaying display data in the discharge cell in which the selective write operation is effected in the addressing period described above.

Here, the apparatus for driving the plasma display panel according to the present invention includes driving means for supplying a reset discharge pulse for the reset discharge described above, an addressing pulse for effecting the write discharge described above and a sustain discharge pulse for effecting the sustain discharge to the sustain electrode, the scan electrode and the addressing electrode; and control means for controlling the sequence for supplying the reset discharge pulse, the addressing pulse and the sustain discharge pulse. The control means applies the reset discharge pulse having a voltage higher than a discharge start voltage necessary for starting the reset discharge to the sustain electrode or the scan electrode in the reset period for a period of time in which the discharge is started in only the discharge cell that has executed the sustain discharge and to the discharge cells adjacent to the discharge cell that has executed the sustain discharge, and in this way, makes the potential difference between the sustain electrode and the scan electrode substantially zero, so that an erase discharge can be executed for at least the cell that has executed the sustain discharge.

Further, the apparatus for driving the plasma display panel according to the present invention includes driving means for supplying a reset discharge pulse for effecting a reset discharge, the addressing pulse for effecting a write discharge and a sustain discharge pulse for effecting a sustain discharge to the sustain electrode, the scan electrode and the addressing electrodes described above; and control means for controlling the sequence of supplying the reset discharge pulse, the addressing pulse and the sustain discharge pulse:

When the odd-numbered field and the even-numbered field are switched over to each other, the control means executes a control so that the whole surface write discharge can be effected by applying a reset discharge pulse having a voltage higher than the discharge start voltage in the pair of the sustain electrode and the scan electrode that has executed, or is to execute, the sustain discharge, a self-erase discharge is effected at the point of time in which the reset discharge pulse having the voltage higher than the discharge start voltage is removed, a voltage having a polarity opposite to that of the voltage of the whole surface write discharge and approximate to the voltage of the sustain discharge pulse is applied for a period at least equal to the width of the sustain discharge pulse; and in the next odd-numbered field or the even-numbered field, the control means executes its control so that the whole surface write discharge can be effected in the pair of the sustain electrode and the scan electrode by applying the reset discharge pulse having a voltage higher than the discharge start voltage, and the self-erase discharge can be effected at the point of time in which the reset discharge pulse having a voltage higher than the discharge start voltage is eliminated.

According to the method for driving the plasma display panel and the apparatus for driving the same in the present invention, the reset discharge is executed by applying the voltage higher than the discharge start voltage to only the discharge cell that has executed the sustain discharge and the discharge cells adjacent to the former discharge cell for the period for starting the discharge when the interlace system driving sequence is executed, and the auxiliary erase pulse having a gentle slope is used thereafter to reliably eliminate the wall charges remaining between the sustain electrodes and the scan electrodes to zero, so that the erase discharge can be carried out mainly in the discharge cells that have executed the sustain discharge and in some case, in the discharge cells adjacent to the former discharge cells, too. Because the discharge is not effected for other discharge cells that do not effect the sustain discharge, on the other hand, stable driving can be accomplished with an improved contrast ratio.

When the odd-numbered fields and the even-numbered fields are switched over to each other in executing the interlace system driving sequence in the method for driving the plasma display panel and the apparatus for driving the same according to the present invention, the similar discharge is executed for the fields before switching, before the whole surface write discharge and the self-erase discharge are effected for the fields after switching of the fields, and thereafter the sustain discharge pulse is applied in the polarity opposite to that of the whole surface write pulse. Therefore, the reset discharge and the addressing discharge after switching of the fields can be executed stably.

BRIEF DESCRIPTION OF THE DRAWINGS

The above object and features of the present invention will be more apparent from the following description of the preferred embodiments with reference to the accompanying drawings, wherein.

DESCRIPTION OF THE PREFERRED EMBODIMENTS

Hereinafter, some preferred embodiments of the present invention will be explained with reference to FIGS. 10A to 17 of the accompanying drawings. These embodiments are preferably applied to a driving sequence of an interlace system plasma display panel.

Figure 10A:
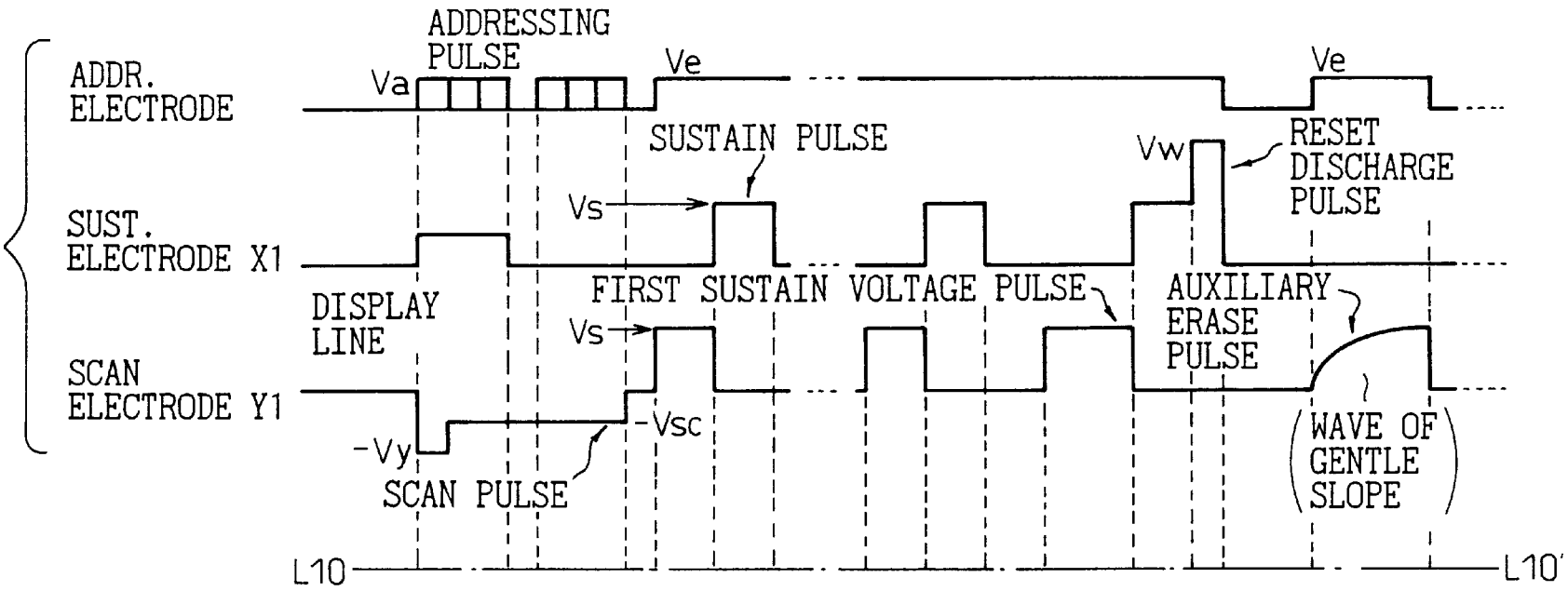
FIGS. 10A and 10B are timing charts (No. 1 and No. 2) useful for explaining a method for driving a plasma display panel according to the first embodiment of the present invention.
Figure 10B:
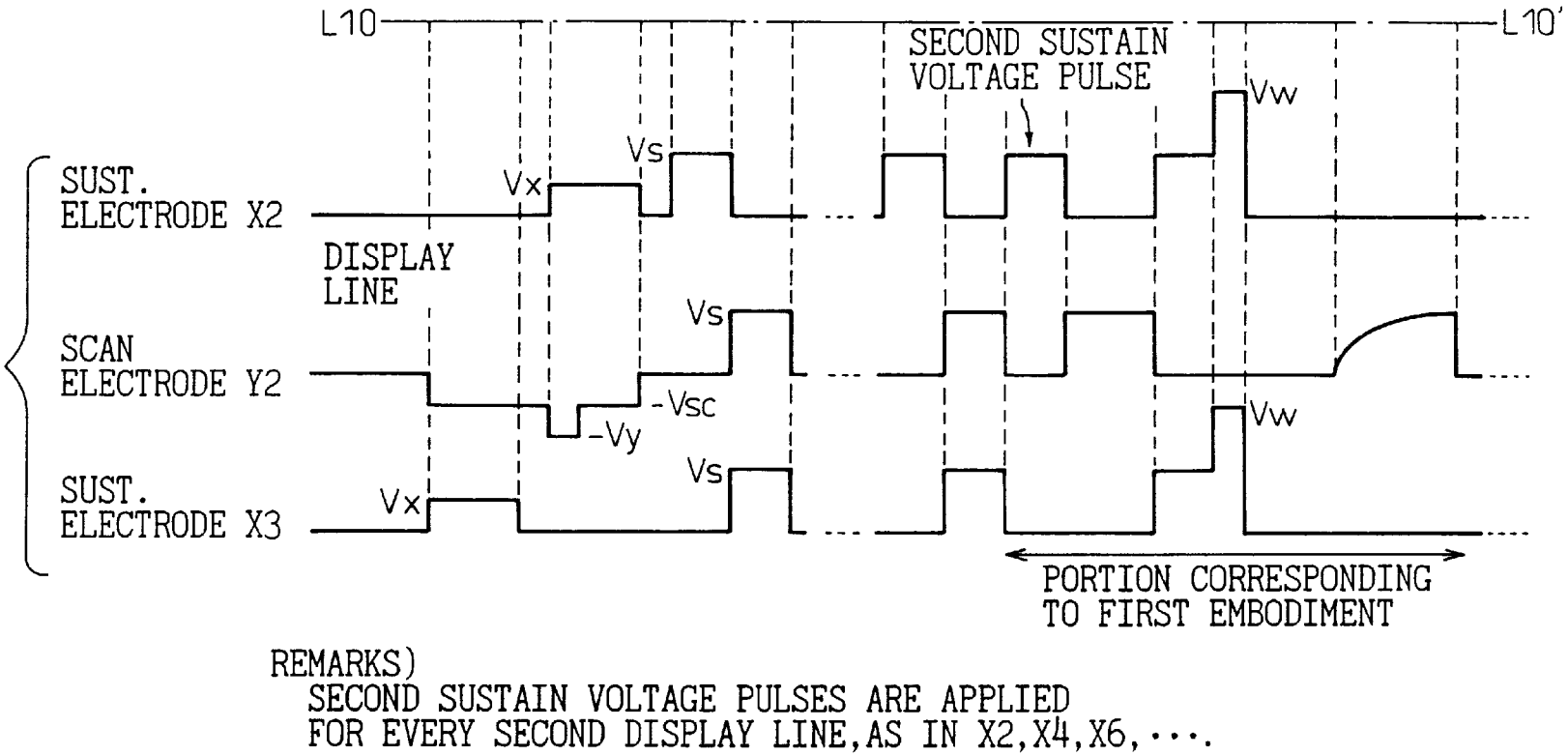

FIGS. 10A and 10B are timing charts (Nos. 1 & 2) useful for explaining a method for driving a plasma display panel according to the first embodiment of the present invention. Hereinafter, like reference numerals will be used to identify like members that have already been explained.

Figure 4:
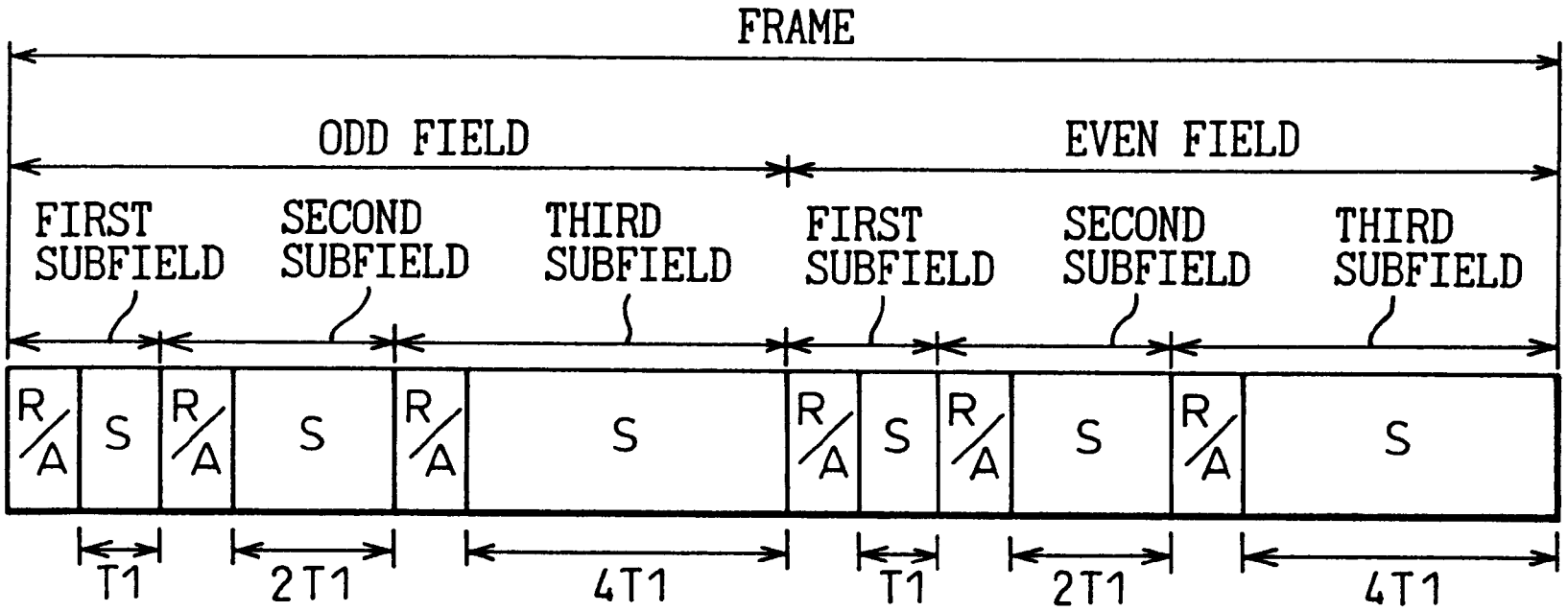
Fig.4 PRIOR ART
FIG. 4 is a schematic view showing a structural example of a frame for forming a color image of the plasma display panel shown in FIG. 1.
Figure 5A:
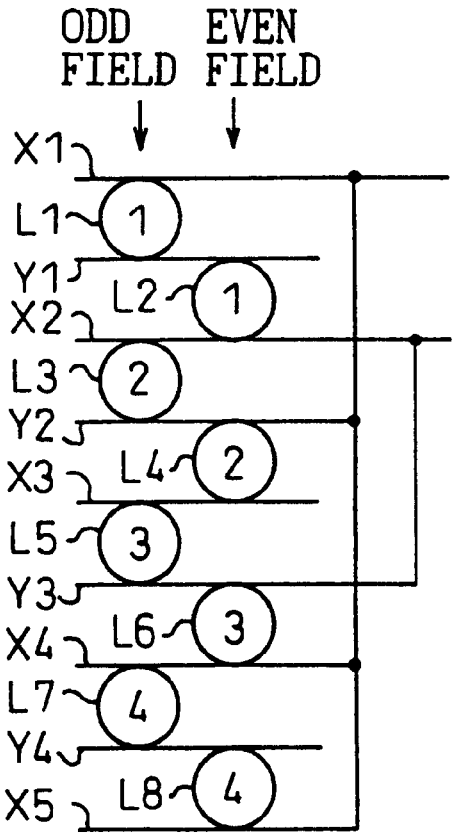
Fig.5A PRIOR ART
FIGS. 5A and 5B are schematic views showing the sequence of display scanning in an addressing period of the frame shown in FIG. 4.
Figure 5B:
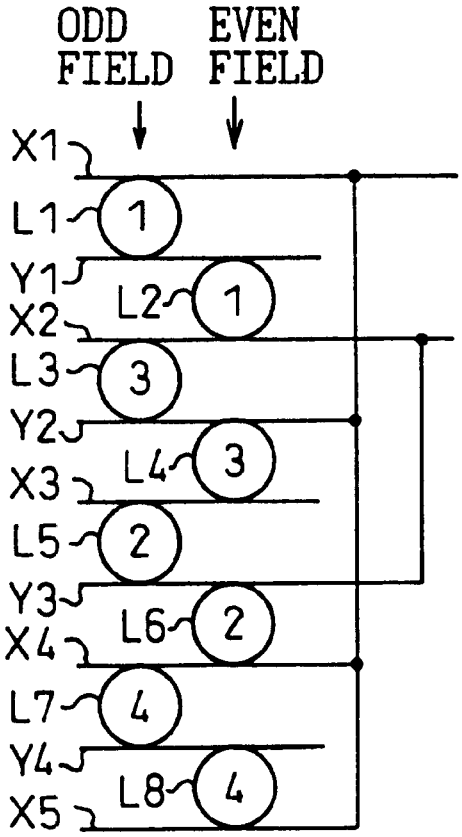
Fig.5B PRIOR ART
Figure 6:
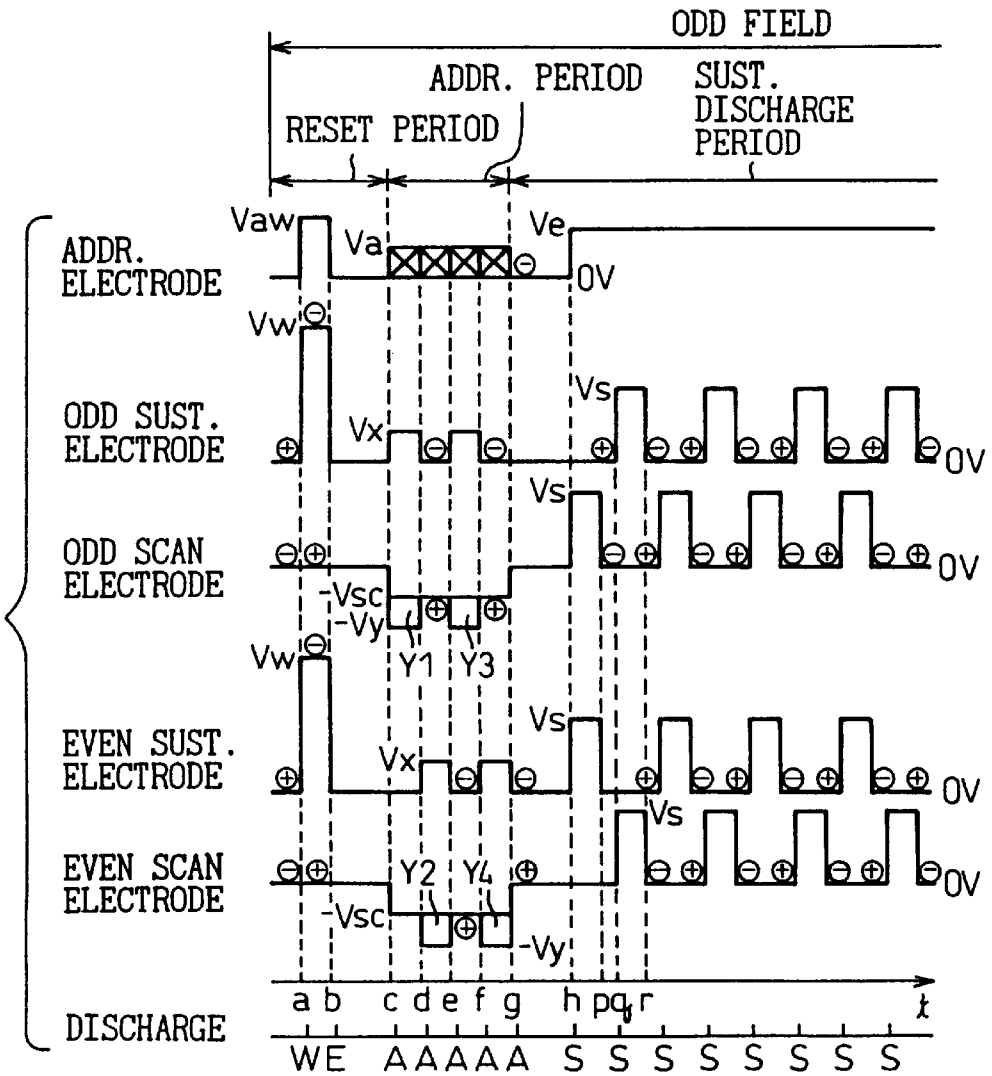
Fig. 6 PRIOR ART
FIG. 6 is a waveform diagram showing the waveforms of voltages applied to the electrodes in odd-numbered fields, and showing a method for driving a plasma display panel according to the first example of the prior art.
Figure 7:
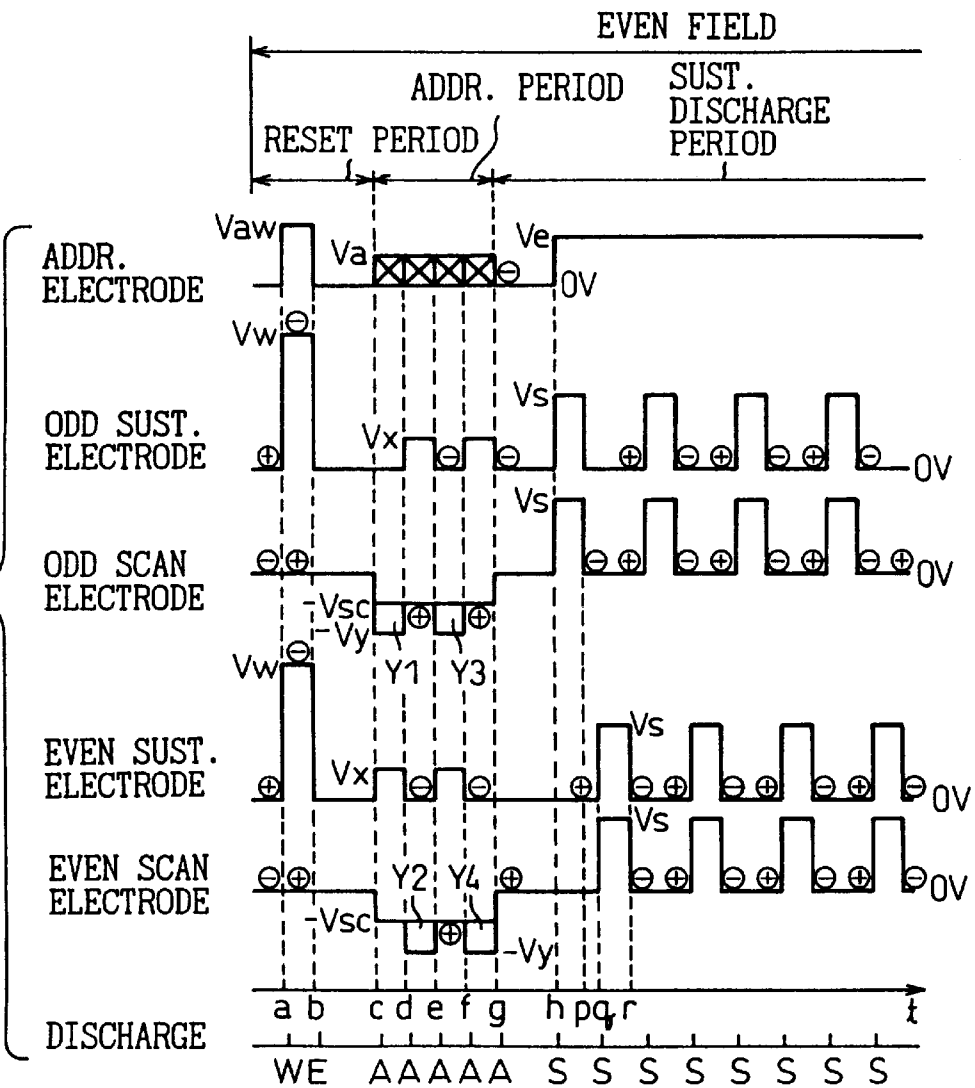
Fig. 7 PRIOR ART
FIG. 7 is a waveform diagram showing the waveforms of voltages applied to the electrodes in even-numbered fields and showing a method for driving a plasma display panel according to the first example of the prior art.

The driving voltage waveforms shown in FIGS. 10A and 10B represent the waveforms of one frame comprising the odd-numbered fields and the even-numbered fields as shown in FIG. 4. In practice, however, each of the odd-numbered and even-numbered fields has a plurality of subfields having mutually different sustain discharge periods but only one sub-field of either one of the odd-numbered and even-numbered fields is shown in order to simplify the explanation.

Figure 8:
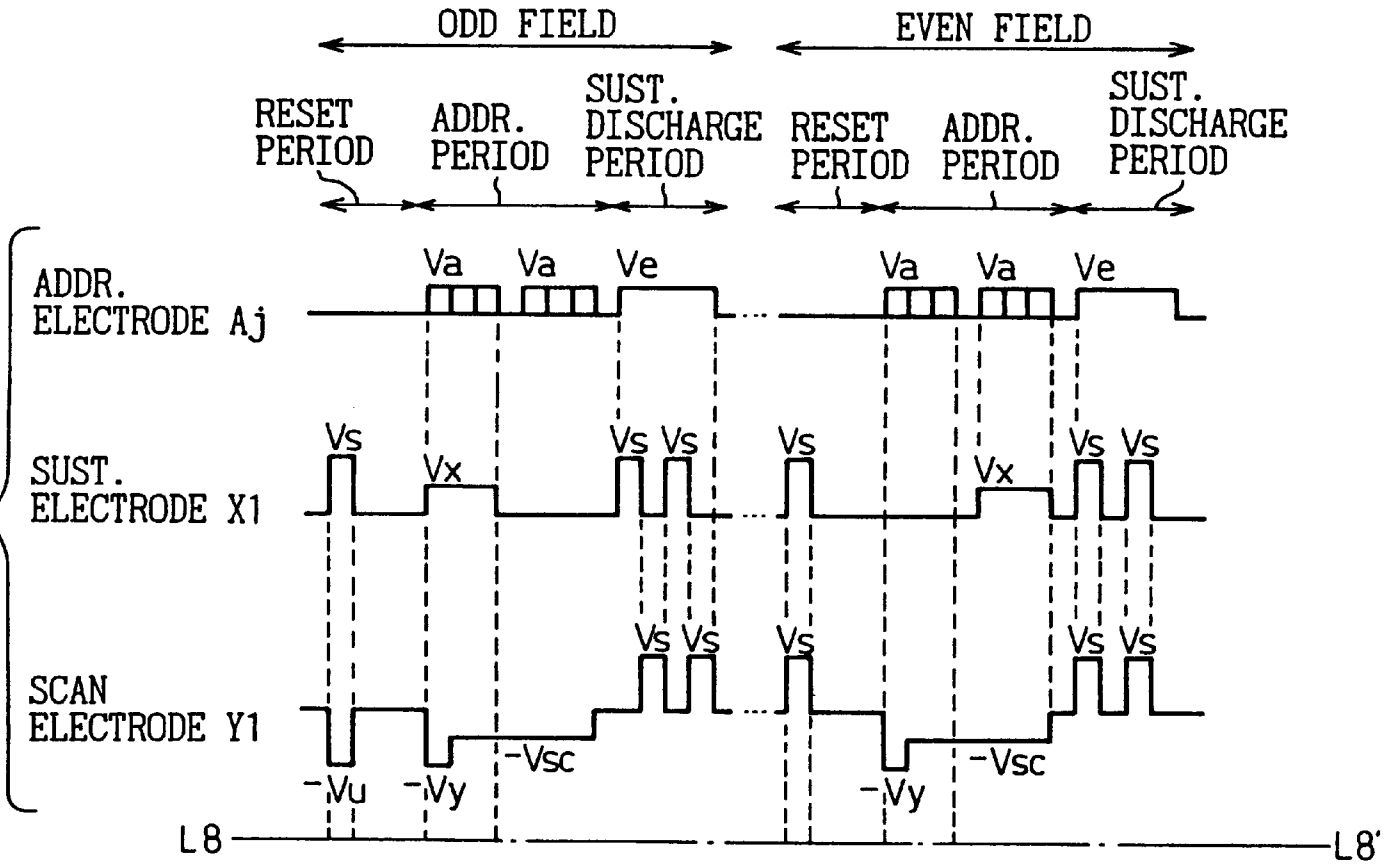
Fig. 8 PRIOR ART
FIG. 8 is a voltage waveform diagram (No. 1) showing a method for driving a plasma display panel according to the second example of the prior art.
Figure 9:
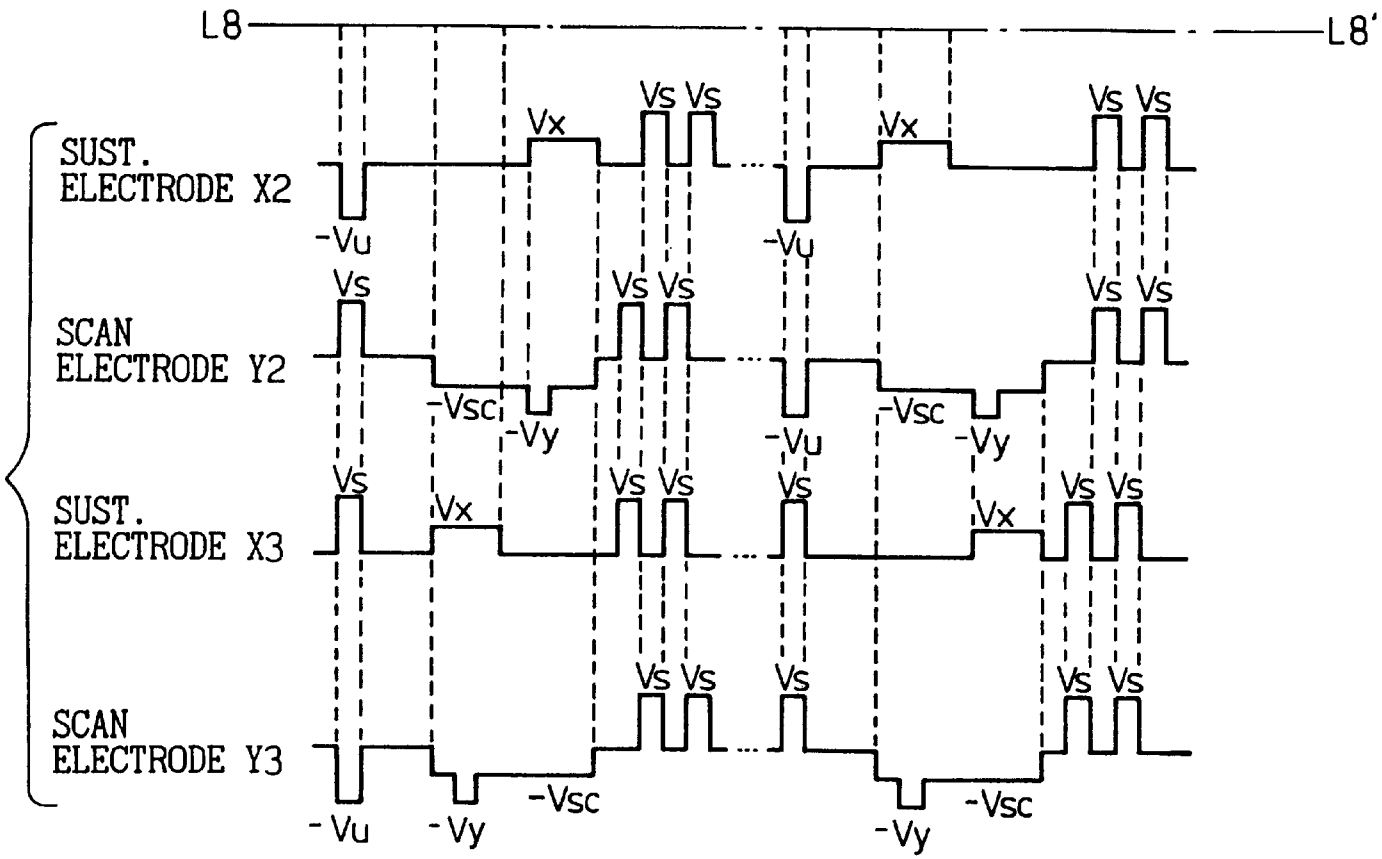
Fig.9 PRIOR ART
FIG. 9 is a voltage waveform diagram (No. 2) showing a method for driving a plasma display panel according to the second example of the prior art.

In FIGS. 10A and 10B, the portion associated with the first embodiment (the portion corresponding to the first embodiment) is represented by arrows. This portion includes the sustain discharge period of a certain sub-field and the reset period of the next sub-field. The driving voltage waveforms in the sustain discharge period and in the periods other than the reset period of the next sub-field are substantially the same as the driving voltage waveform in the second example of the prior art shown in FIGS. 8 and 9 and the detailed explanation will be therefore omitted hereby. Incidentally, the portion corresponding to the respective embodiment will be represented by the arrows in the later-appearing second to fourth embodiments (FIGS. 11A to 13B) in the same way as in FIGS. 10A and 10B.

In the first embodiment shown in FIGS. 10A and 10B, a level difference is formed in the reset discharge pulse for executing the erase discharge in the cell that has executed the sustain discharge in the reset period after the completion of the sustain discharge period of a certain sub-field (that is, in the reset period of the next sub-field) and to the cells adjacent to the former cell.

The explanation will be given in more detail. A voltage approximately the same as the voltage Vs of the sustain pulse is applied to the sustain electrode in the former half of the reset discharge pulse so as to effect the sustain discharge for the cell which is to execute the display write operation and furthermore, a voltage Vw higher than the discharge start voltage is applied in the latter half of the reset discharge pulse for the period in which the discharge is started in only the cell that has executed the sustain discharge and in the cell adjacent to the former cell, e.g., the time period not longer than 2 $\mu$s. Moreover, the time in which the voltage Vw is higher than the discharge start voltage is set to a value not larger than a predetermined time such as 2 $\mu$s.

Since the level difference described above is provided to the reset discharge pulse, the pulse higher than the discharge start voltage at the latter half of this level difference is applied for the period in which the discharge is started in only the cell that has executed the sustain discharge and in the cells adjacent to the former cell, so that the erase discharge is effected for the cell that has executed the sustain discharge and, in some cases, for the cells adjacent to the former cell.

In consequence, the reset discharge is not effected in the surrounding cells, which do not execute the sustain discharge, unless these cells execute, by themselves, the display write discharge. Therefore, background light emission can be kept at a low level and the contrast ratio can be improved.

In the first embodiment shown in FIGS. 10A and 10B, further, the auxiliary erase pulse (a wave of a gentle slope) having the same polarity as that of the reset discharge pulse and a gentle slope is applied to the scan electrode after the passage of the period in which the reset discharge pulse is applied until the potential difference between the sustain electrode and the scan electrode is made zero. This auxiliary erase pulse is applied to the electrode different from the electrode to which the reset discharge pulse is applied and, for this reason, the wall charges having the opposite polarity to that of the wall charges generated by the reset discharge pulse are generated. In other words, this auxiliary erase pulse is applied in order to eliminate substantially completely the wall charges that have the opposite polarity to that of the voltage of the whole surface write voltage and remain even after the self-erase discharge is executed.

Preferably, further, in the first embodiment shown in FIGS. 10A and 10B, a first sustain voltage pulse having the same polarity as that of the reset discharge pulse having a voltage higher than the discharge start voltage and a width larger than the width of the sustain pulse is applied to the scan electrode before the reset discharge pulse having a voltage higher than the discharge start voltage is applied but after the completion of the sustain discharge period. The voltage of this first sustain voltage pulse is set to a value substantially equal to the voltage Vs of the sustain pulse. In this case, the first sustain voltage pulse having the width larger than the width of the ordinary sustain discharge pulse is applied before the voltage pulse higher than the discharge start voltage so as to attract the wall charges of the cell that has executed the sustain discharge, and in this way, the erase discharge can be carried out reliably.

Preferably, further, in the first embodiment shown in FIGS. 10A and 10B, a second sustain voltage pulse having a width larger than the width of the sustain discharge pulse is applied for every other display line between the sustain discharge period and the first sustain voltage pulse applied before the application of the reset discharge pulse having a voltage higher than the discharge start voltage. Because the second sustain voltage pulse equivalent to the ordinary sustain discharge pulse is applied in this way for every other display line, the erase discharge by the voltage pulse higher than the discharge start voltage after the completion of the sustain discharge period can be reliably executed by aligning the number of discharges of the sustain discharge pulses in each display line and aligning the polarity of the wall charges after the completion of the sustain discharge period.

Figure 11A:
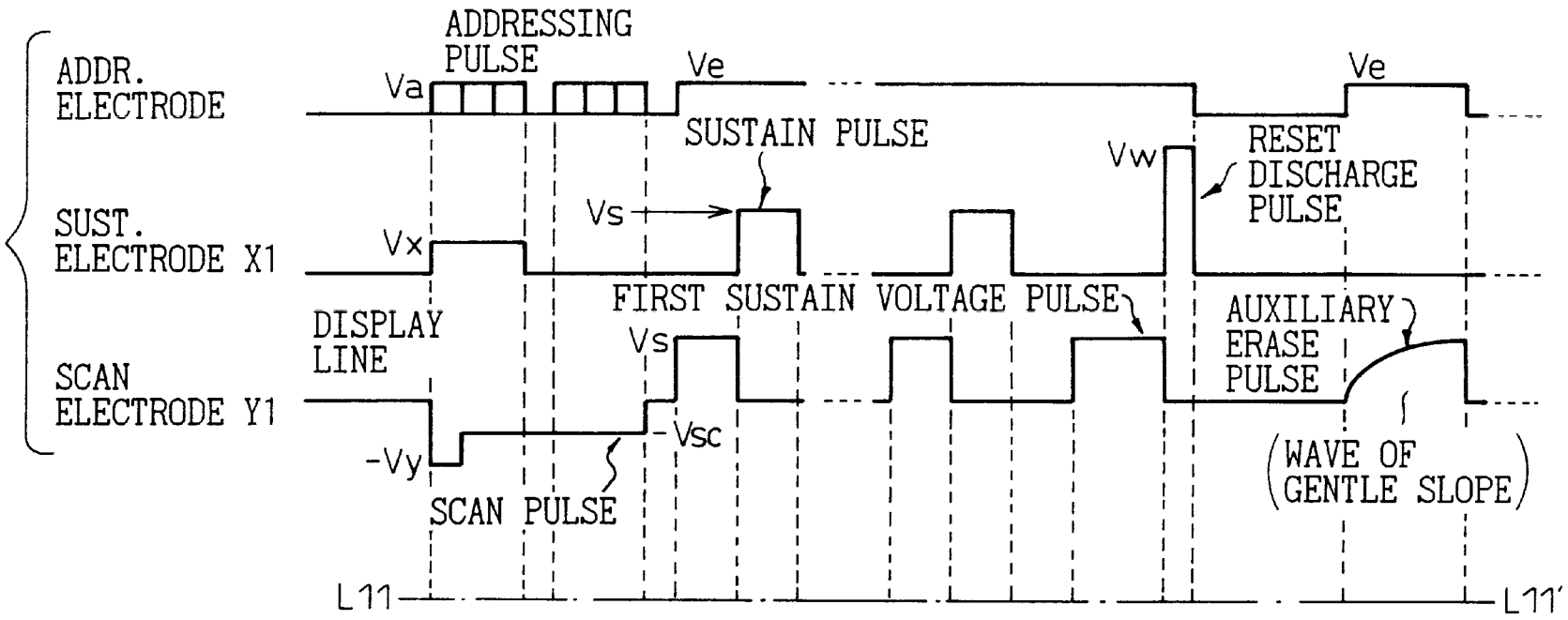
FIGS. 11A and 11B are timing charts (No. 1 and No. 2) useful for explaining a method for driving a plasma display panel according to the second embodiment of the present invention.
Figure 11B:
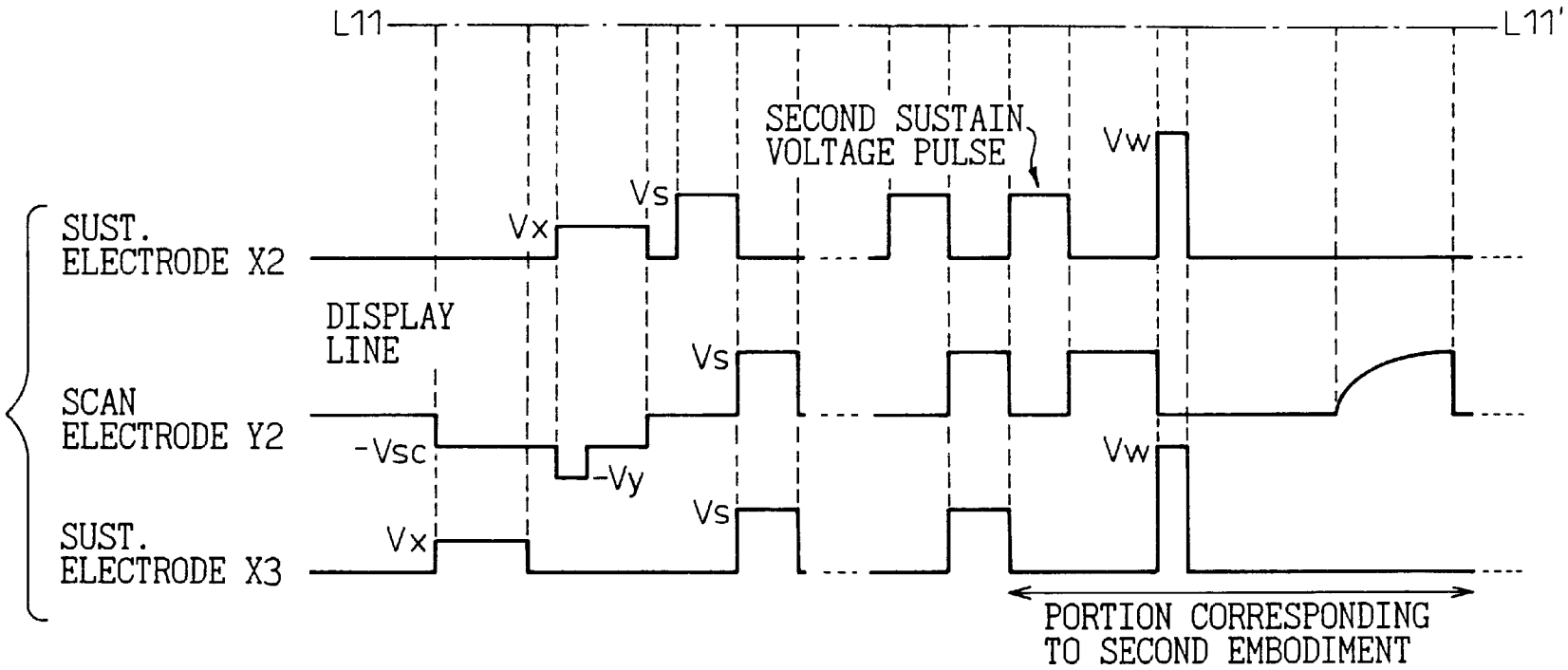

FIGS. 11A and 11B are timing charts (Nos. 1 & 2) useful for explaining the method for driving the plasma display panel according to the second embodiment of the present invention.

In the second embodiment shown in FIGS. 11A and 11B, a reset discharge pulse having a small width and a voltage Vw higher than the discharge start voltage is applied to the sustain electrode. Preferably, this reset discharge pulse is applied to every other sustain electrode and at the same timing.

Moreover, because the pulse width of the voltage pulse higher than the discharge start voltage is set to be a value not larger than 2 $\mu$s, the cells that have executed the sustain discharge react quickly, and the write discharge and the self erase discharge are executed. On the other hand, since the cells that have not executed the sustain discharge do not react with a voltage pulse having the pulse width that is equal to or smaller than 2 $\mu$s, the write discharge and the self erase discharge are not executed.

Accordingly, since the reset discharge need not be executed in the cells that have not executed the sustain discharge, background emission light can be limited to a low level and the contrast ratio can be improved.

Figure 12A:
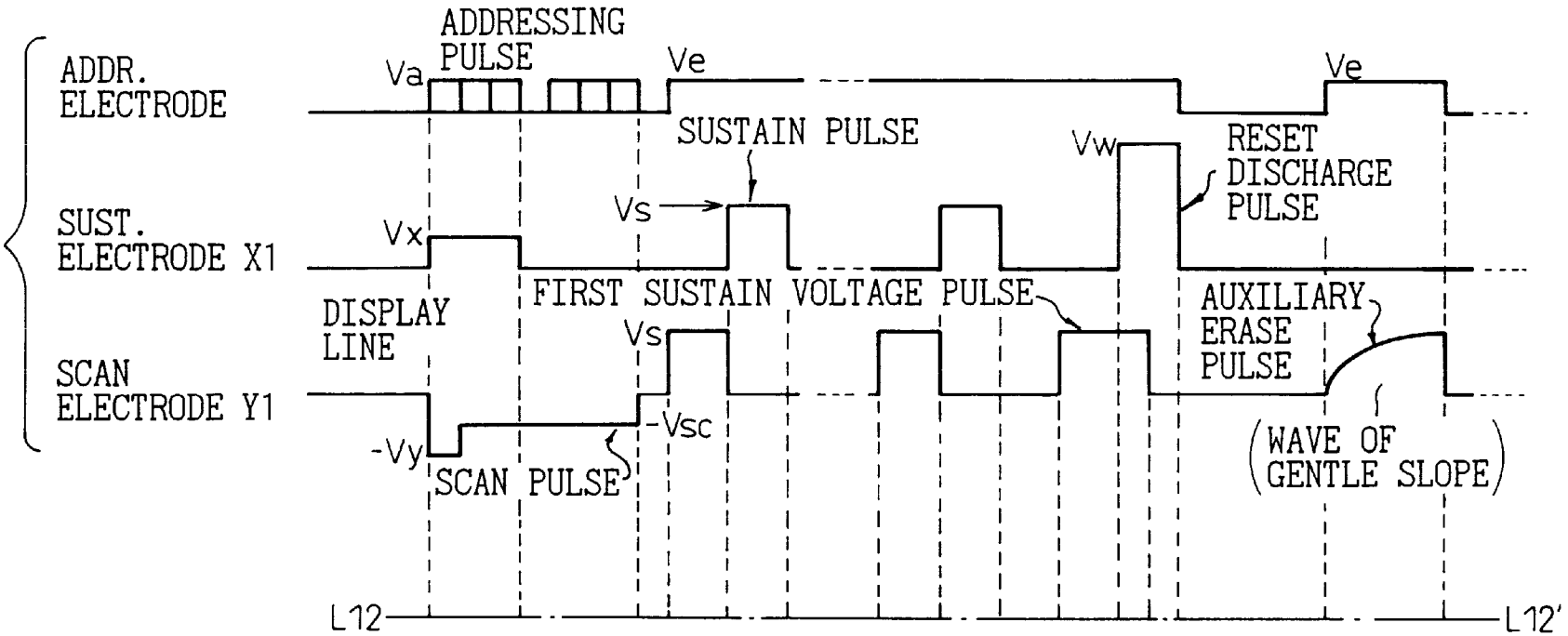
FIGS. 12A and 12B are timing charts (No. 1 and No. 2) useful for explaining a method for driving a plasma display panel according to the third embodiment of the present invention.
Figure 12B:
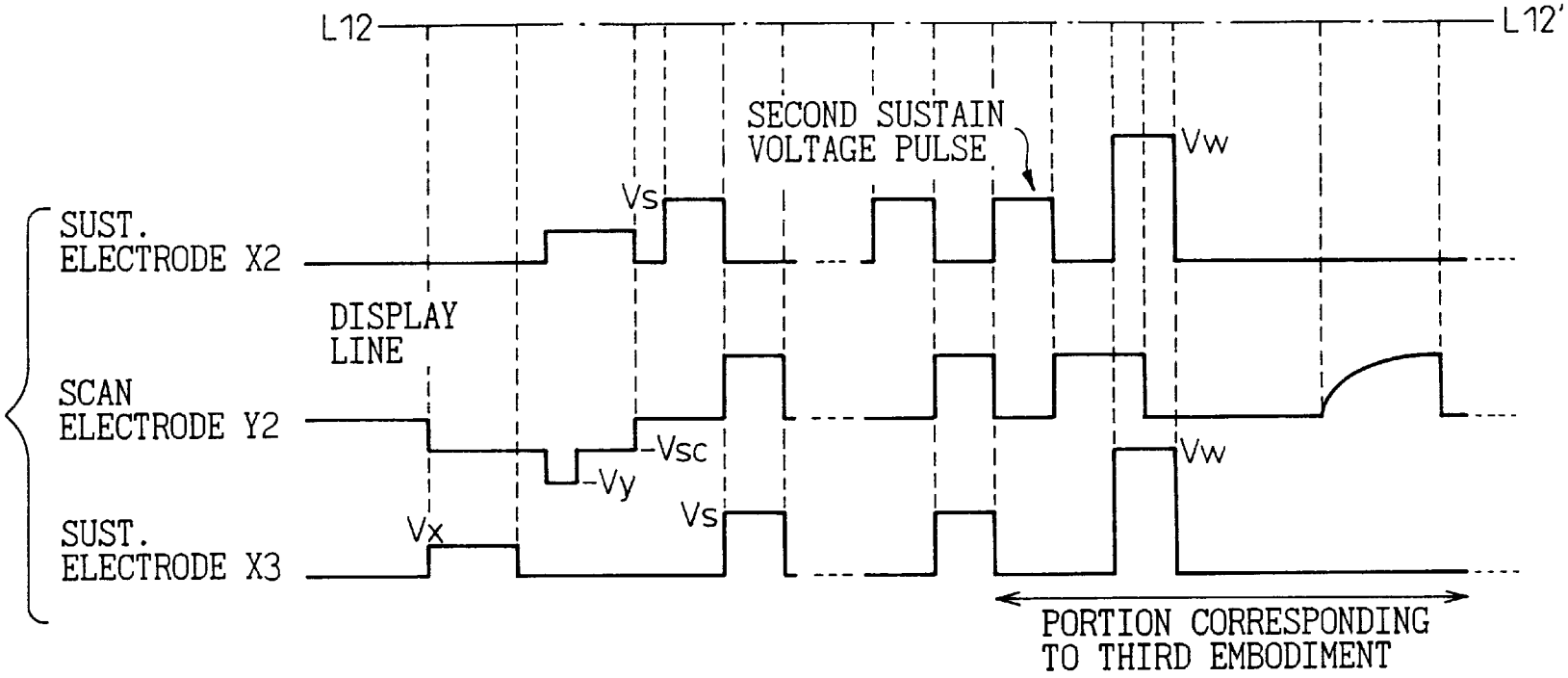

FIGS. 12A and 12B are timing charts (Nos. 1 and 2) useful for explaining the method for driving the plasma display panel according to the third embodiment of the present invention.

In the third embodiment shown in FIGS. 12A and 12B, the period in which the sustain voltage substantially equal to the voltage Vs of the sustain pulse and having a width larger than the width of the sustain pulse is applied to the scan electrode and the period in which the reset discharge pulse having the voltage Vw higher than the discharge start voltage and having a large width is applied to the sustain electrode are arranged so as to partially overlap with each other after the completion of the sustain discharge period.

Because such sustain voltage and reset discharge pulse are supplied, it becomes possible to apply the reset discharge pulse having the level difference which is similar to the case of the first embodiment (shown in FIGS. 10A and 10B) between the sustain electrode and the scan electrode.

Figure 13A:
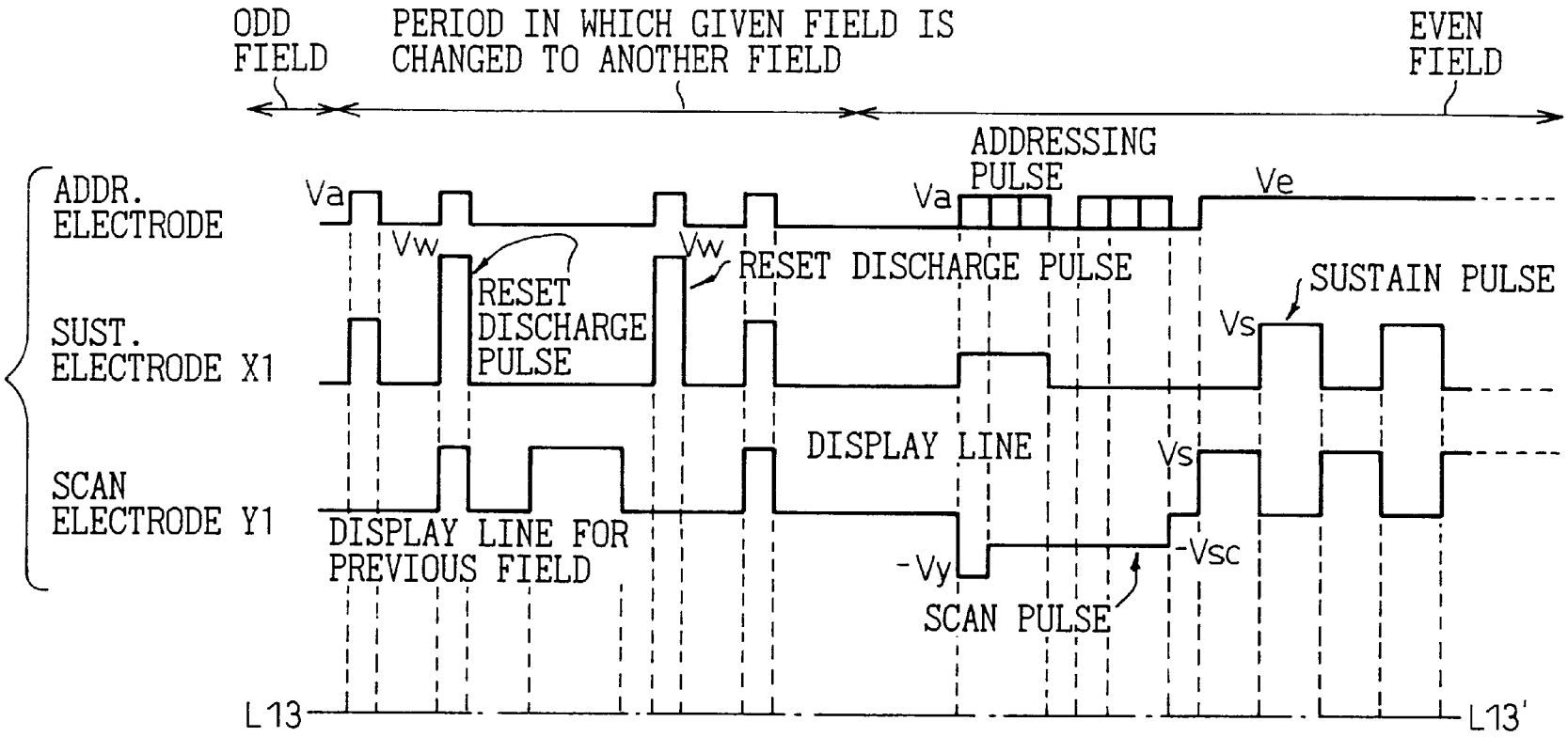
FIGS. 13A and 13B are timing charts (No. 1 and No. 2) useful for explaining a method for driving a plasma display panel according to the fourth embodiment of the present invention.
Figure 13B:
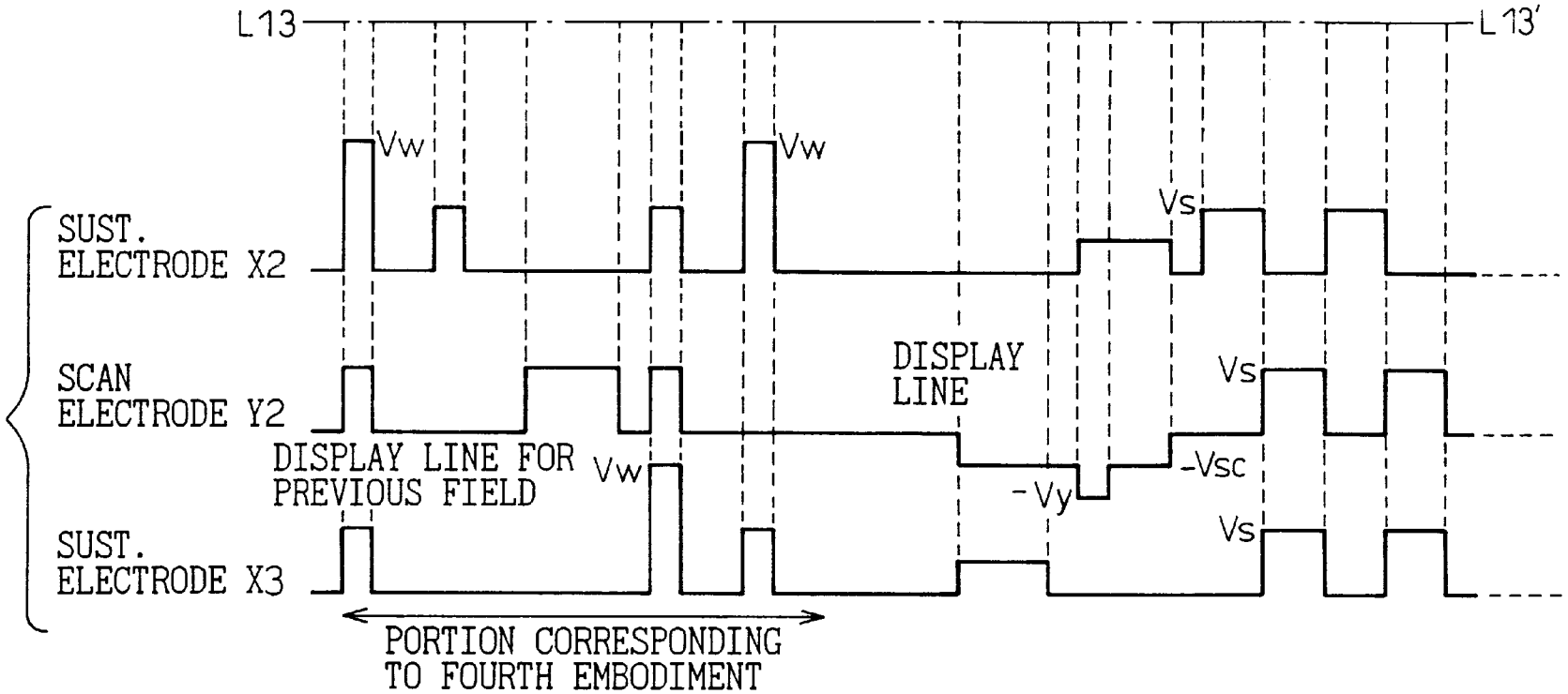

FIGS. 13A and 13B are timing charts (Nos. 1 and 2) useful for explaining the method for driving the plasma display panel according to the fourth embodiment of the present invention.

In the fourth embodiment shown in FIGS. 13A and 13B, the reset discharge pulse higher than the discharge start voltage is applied to the pair of the sustain electrode and the scan electrode that has executed the sustain discharge in the immediately previous odd-numbered field, during the switching period, in which the odd-numbered field and the even-numbered field are switched over to each other, so as to execute the whole surface write discharge, and the self-erase discharge is executed at the point of time in which this reset discharge pulse is eliminated, so as to complete the reset process.

Further, after such a reset process is executed, this embodiment executes another reset process in which a voltage having the opposite polarity to that of the voltage of the whole surface write discharge and substantially equal to the sustain discharge voltage is applied for a period larger than the width of the sustain discharge pulse, the reset discharge pulse of the voltage higher than the discharge start voltage is applied to the pair of the sustain electrode and the scan electrode that is to effect the sustain discharge in the next even-numbered field, so as to execute the whole surface write discharge and when this reset discharge pulse is eliminated, the self erase discharge is effected.

Preferably, in the fourth embodiment described above, the reset step is first executed for the pair of the sustain electrode and the scan electrode of either one of the odd-numbered and even-numbered display lines among the pairs of the sustain electrodes and the scan electrodes that have executed the sustain discharge in the immediately previous field during the field switching period, in which the odd-numbered field and the even-numbered field are switched over to each other, and then the same reset process is executed for the pair of the sustain electrode and the scan electrode of the other display line.

In the field switching period in the fourth embodiment described above, the whole surface write discharge and the self erase discharge are executed for the electrode pair that has executed the sustain discharge in the previous field and then the sustain voltage pulse, which has an opposite polarity to that of the voltage pulse of the voltage higher than the discharge start voltage and a pulse width at least equal to that of the sustain discharge pulse, is applied so that the wall charges of the opposite polarity that remain due to the self-erase discharge (the negative wall charges on the sustain electrode and the positive wall charges on the scan electrode) can be inverted and the reset discharge, the addressing discharge and the sustain discharge of the electrode pair that is to effect the sustain discharge in the next field can be carried out stably.

Figure 14:
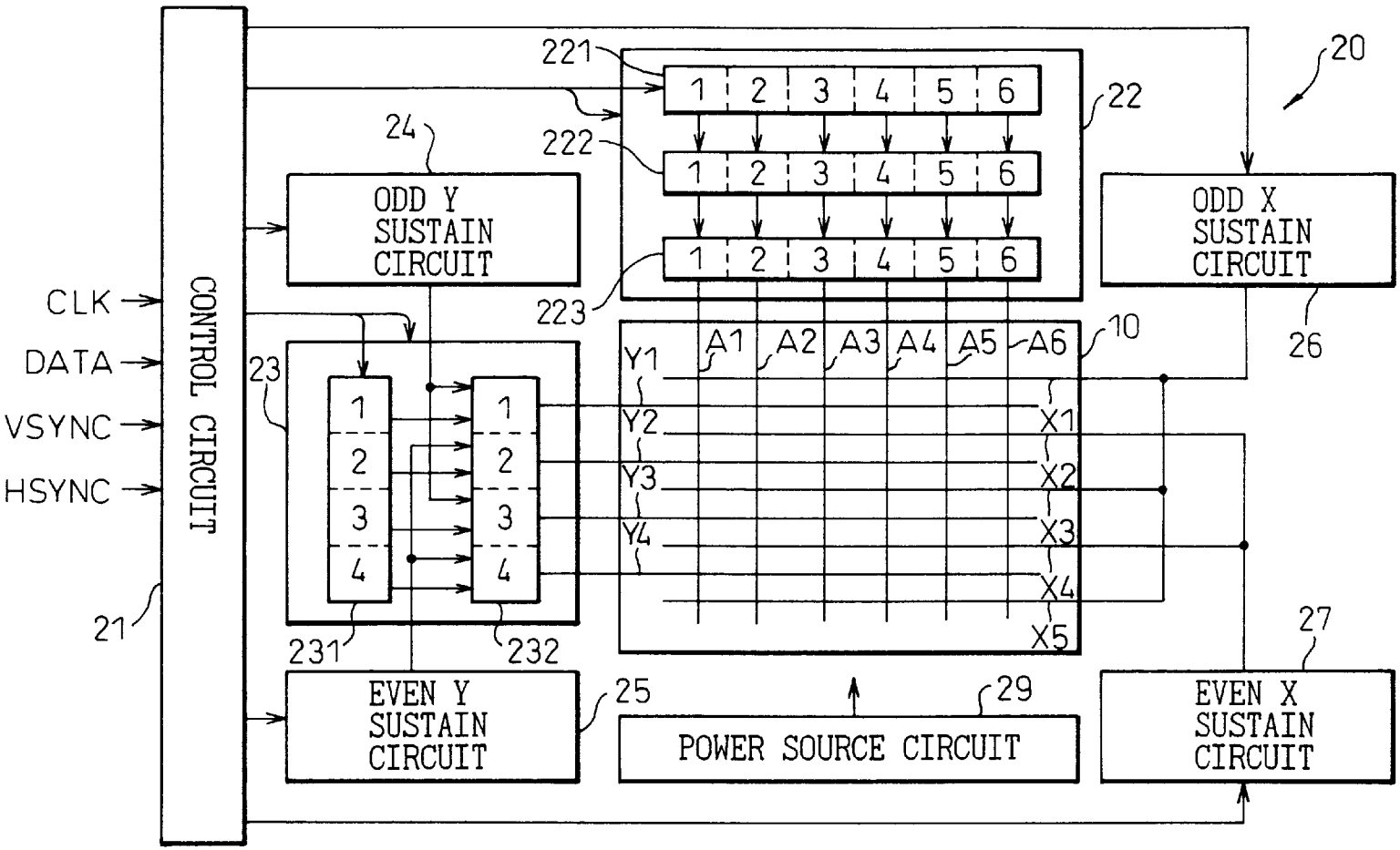
FIG. 14 is a block diagram showing a schematic construction of an apparatus for driving a plasma display panel to which the driving method of the present invention is applied.

FIG. 14 is a block diagram showing a schematic construction of the apparatus for driving the plasma display panel to which the driving method according to the embodiments of the present invention is applied.

In FIG. 14, a control circuit 21 converts the display data DATA supplied from outside to data for a display panel 10 comprising the plasma display panel and supplies the display data to a shift register 221 of an addressing circuit 22. Further, the control circuit 21 generates a plurality of control signals on the basis of a clock CLK, a vertical synchronous signal VSYNC and a horizontal synchronous signal HSYNC supplied from outside, and supplies them to various driving circuits.

In order to apply the driving voltage waveforms shown in FIGS. 10A to 13B to various electrodes, a power source circuit 29 supplies voltages Vaw, Va and Ve to an addressing circuit 22, voltages −Vsc, −Vy and Vs to each of the odd Y sustain circuit 24 and the even Y sustain circuit 25 and voltages Vw, Vx and Vs to each of the odd X sustain circuit 26 and the even X sustain circuit 27.

Numerals in the shift register 221 are for distinguishing elements having mutually the same construction. For example, reference numeral 221(3) denotes the third bit of the shift register, and this also holds true of other constituent elements.

In the addressing circuit 22, when the display data for one row (for one display line) are supplied from the control circuit 21 to the shift register 221 in the addressing period, the bits 221(1) to 221(6) are latched by the bits 222(1) to 222(6) of a latch circuit 222, respectively, switching devices (not shown) inside drivers 223(1) to 223(6) are subjected to ON/OFF control and a binary voltage pattern of the voltage Va or 0V is supplied to the addressing electrodes A1 to A6.

A scanning circuit 23 includes a shift register 231 and a driver 232. In the addressing period, a logic level "1" is applied to a series data input terminal of the shift register 231 in only the first address cycle of each cycle of the vertical synchronous signal VSYNC and is shifted in synchronism with the address cycle. The switching devices (not shown) inside the drivers 232(1) to 232(6) are subjected to the ON/OFF control in accordance with the values of the bits 231(1) to 231(4) of the shift register 231, and a selected voltage −Vy or a non-selected voltage −Vsc is applied to the scan electrodes Y1 to Y4. In other words, the scan electrodes Y1 to Y4 are serially selected by the shift of the shift register 231, the selected voltage −Vy is applied to the scan electrode Y so selected, and the non-selected voltage −Vsc is applied to the non-selected scan electrode Y. These voltages −Vy and −Vsc are supplied from an odd-numbered sustain circuit 24 and an even-numbered sustain circuit 25. In the sustain discharge period, a train of the first sustain pulses are supplied to the odd-numbered scan electrodes Y1 and Y3 of the scan electrodes from the odd-numbered Y sustain circuit 24 through the drivers 232(1) and 232(3), and a train of the second sustain pulses having a phase deviated by 180° from the train of the first sustain pulses are supplied from the even-numbered Y sustain circuit 25 to the even-numbered scan electrodes Y2 and Y4 among the scan electrodes through the drivers 232(2) and 232(4).

In the circuit of the sustain electrodes X, the train of the second sustain pulses described above are supplied to the odd-numbered sustain electrodes X1, X3 and X5 among the sustain electrodes from the odd-numbered X sustain circuit 26 through the driver 281 in the sustain discharge period, and the train of the first sustain pulses are supplied to the even-numbered electrodes X2 and X4 among the sustain electrodes from the even-numbered X sustain circuit 27. In the reset period, the whole surface write pulses are supplied in common from the odd-numbered X sustain circuit 26 and the even-numbered sustain circuit 27 to the sustain electrodes X1 to X5. In the addressing period, the train of the sustain pulses of two address cycles are supplied from the odd-numbered X sustain circuit 26 to the odd-numbered sustain electrodes X1, X3 and X5 among the sustain electrodes, and the train of the pulses having a phase deviated by 180° from the phase of the train of the former pulses described above are supplied from the even-numbered X sustain circuit 27 to the even-numbered electrodes X2 and X4 among the sustain electrodes.

In other words, the circuits 223, 232, 24, 26 and 27 described above are the switching circuits for turning ON/OFF the voltages supplied from the power source circuit 29.

Figure 1:
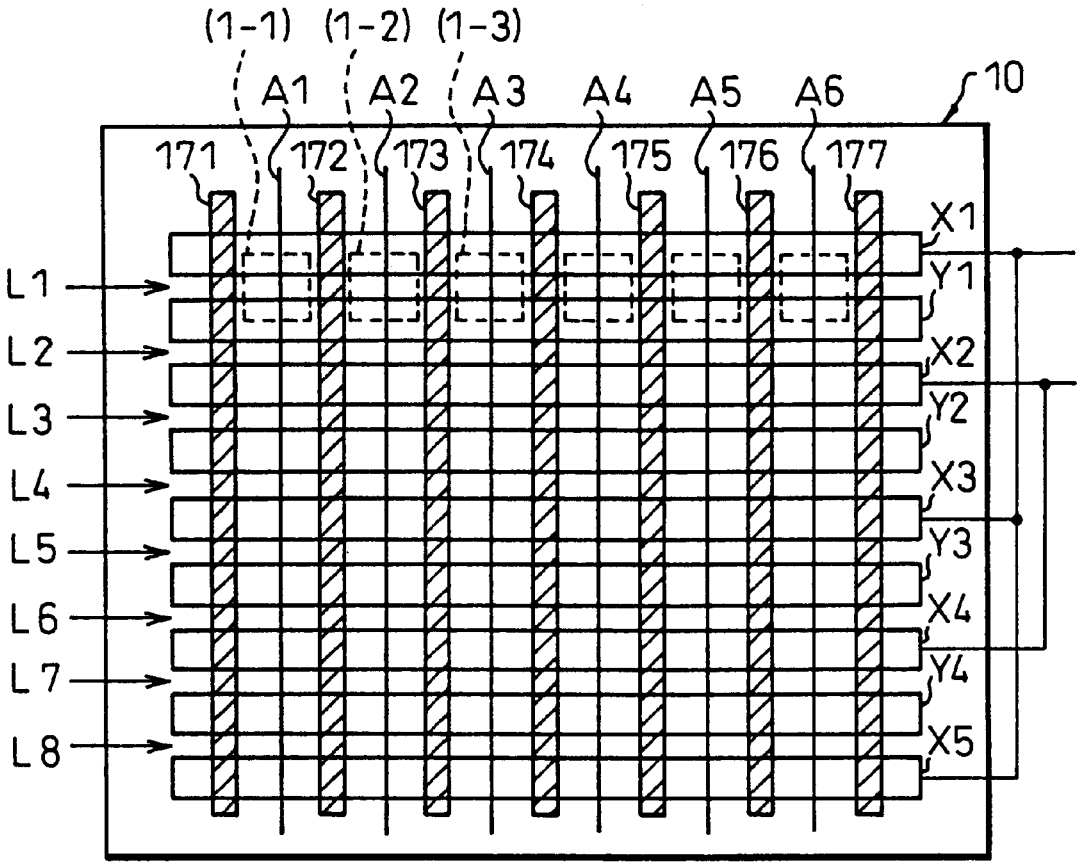
Fig.1 PRIOR ART
FIG. 1 is a plan view showing a schematic construction of a surface discharge type plasma display panel according to the prior art.
Figure 2:
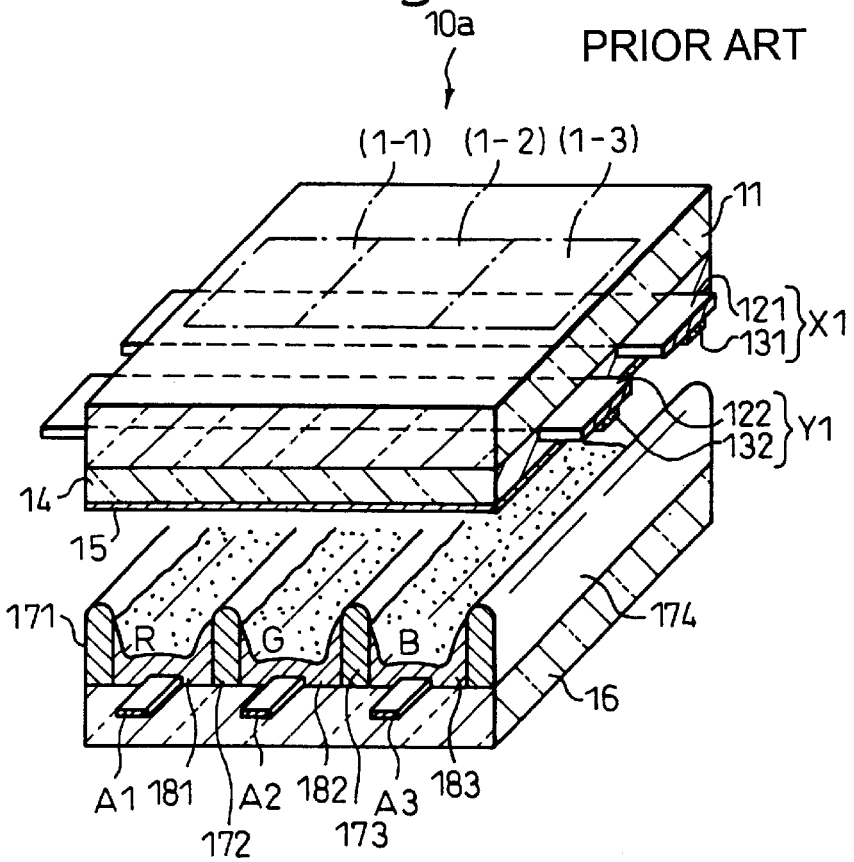
FIG. 2 is an explanatory view showing the state in which an opposing gap between color pixels of the plasma display panel is expanded.
Figure 3:
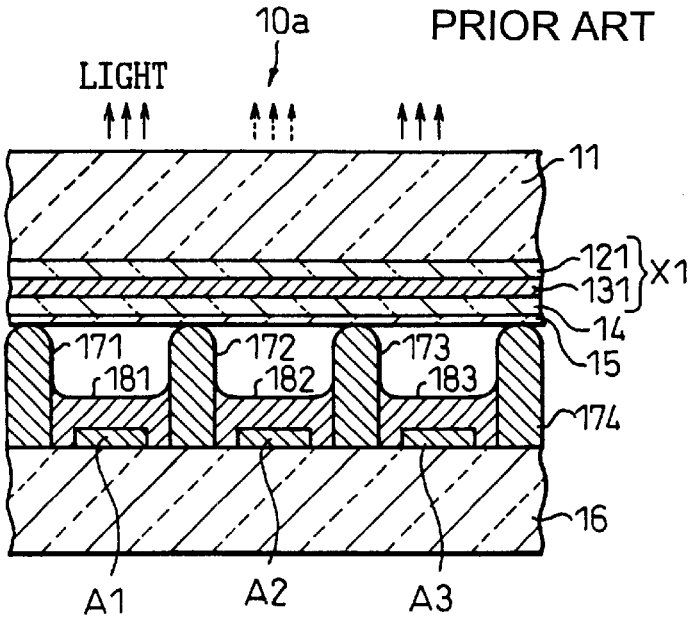
FIG. 3 is a longitudinal sectional view along a sustain electrode X1 of the color pixel of the plasma display panel shown in FIG. 1.
Figure 15:
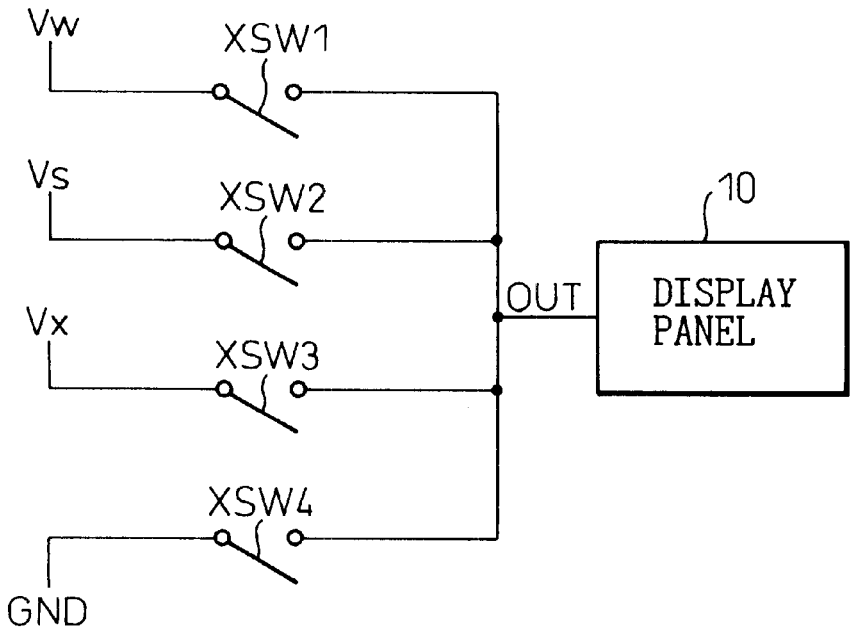
FIG. 15 is a circuit diagram showing a concrete structural example of an even-numbered sustain circuit and an odd-numbered sustain circuit shown in FIG. 14.
Figure 16:
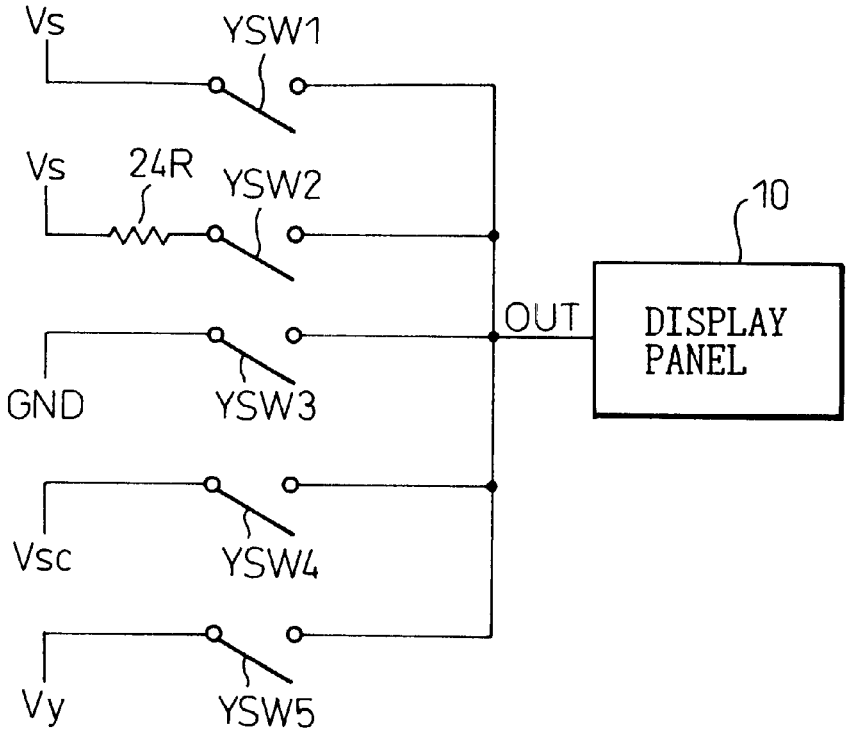
FIG. 16 is a circuit diagram showing a concrete structural example of an even-numbered sustain circuit and an odd-numbered sustain circuit shown in FIG. 13.
Figure 17:
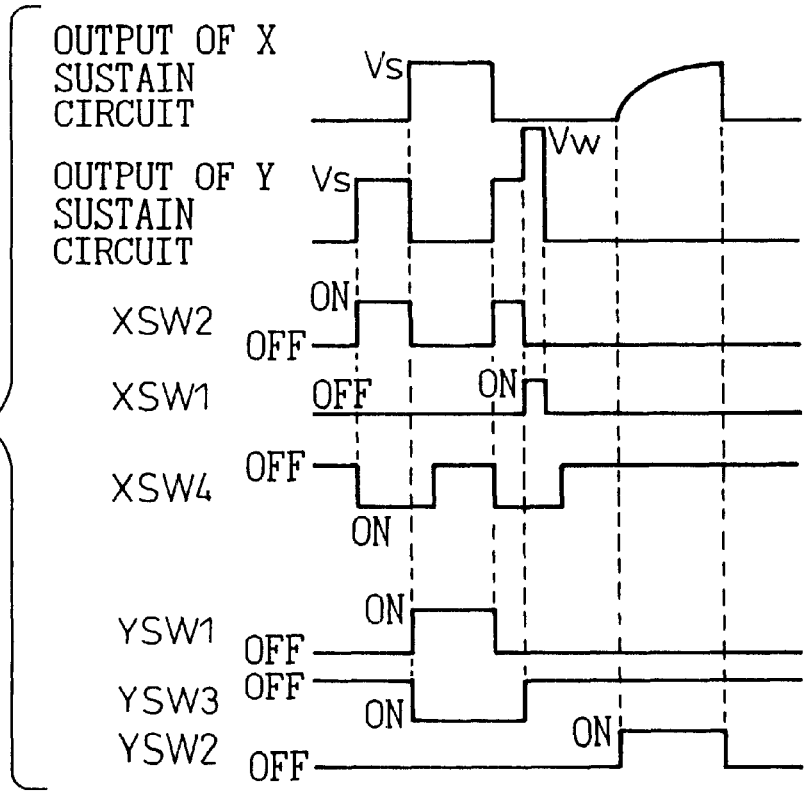
FIG. 17 is a voltage waveform diagram showing the operations of a sustain circuit for accomplishing the driving method according to the first embodiment of the present invention shown in FIG. 10.

FIG. 15 is a circuit diagram showing a concrete structural example of the odd-numbered X sustain circuit and the odd-numbered X sustain circuit shown in FIG. 14; FIG. 16 is a circuit diagram showing a concrete structural example of the odd-numbered Y sustain circuit and the odd-numbered Y sustain circuit; and FIG. 17 is a voltage waveform diagram showing the operations of the sustain circuits for accomplishing the driving method according to the first embodiment shown in FIG. 1.

However, the even-numbered X sustain circuit and the odd-numbered X sustain circuit have the same circuit construction and the even-numbered Y sustain circuit and the odd-numbered Y sustain circuit have the same circuit construction. Therefore, either one of the X sustain circuits and either one of the Y sustain circuits are shown in FIGS. 15 and 16, respectively.

As shown in FIG. 15, the X sustain circuit includes three switching devices SW1, SW2 and SW3 for supplying the voltages Vw, Vs and Vx to the sustain electrodes inside the display panel 10, respectively, on the basis of the control signal from the control circuit 21. Further, the X sustain circuit includes a switching device XSW4 for supplying the ground potential GND to the sustain electrodes.

On the other hand, the Y sustain circuit includes three switching devices YSW1, YSW4 and YSW5 for supplying the voltages Vs, Vsc and Vy to the scan electrodes inside the display panel 10, respectively, on the basis of the control circuit 21, as shown in FIG. 16. Further, the Y sustain circuit includes a resistor 24R and a switching device YSW2 for supplying an auxiliary extinction pulse having a gentle slope (such as a peak voltage Vs) to the scan electrodes. Further, the Y sustain circuit includes a switching device YSW3 for supplying the ground potential GND to the scan electrodes.

As is obvious from FIG. 17, the sustain pulse, the sustain voltage and the reset discharge pulse having the level difference can be supplied easily in the sustain discharge period and in the reset period by appropriately adjusting the ON/OFF timings of the switching devices XSW1, XSW2, XSW4, YSW1, YSW2 and YSW3.

Incidentally, the scan pulses, etc, can be supplied easily in the addressing period by appropriately adjusting the ON/OFF timings of the switching devices XSW3, YSW4 and YSW5, though the voltage waveform diagram is not shown, in particular.

As explained above, according to the typical embodiments of the present invention, in the first place, the voltage pulse higher than the discharge start voltage is applied for the period in which the discharge is started in the cell that has executed the sustain discharge and in the cells adjacent to the former cell. Accordingly, the erase discharge is mainly effected in only the cell that has executed the sustain discharge and in some cases, in the cells adjacent to the former cell, and since the discharge does not occur by the voltage pulse in the cell not corresponding to the former case, that is, the cells that do not effect the sustain discharge, background light emission can be reduced and the contrast ratio can be improved.

According to the typical embodiments of the present invention, in the second place, the erase discharge is effected by the voltage pulse higher than the discharge start voltage having the pulse width not larger than 2 $\mu$s in only the cell that has effected the sustain discharge and in the cells adjacent to the former cell, and because the discharge does not occur in the cells not corresponding to the case described above, that is, the cells not effecting the sustain discharge, even though the voltage having the pulse width not larger than 2 $\mu$s is applied, background light emission can be reduced and the contrast ratio can be improved.

According to the typical embodiments of the present invention, in the third place, the auxiliary erase pulse having a gentle slope is used to completely eliminate the residual charge in consideration of the fact that the residual charges exist dispersively if the erase discharge is made by the voltage pulse higher than the discharge start voltage so that the erase discharge can be made for the residual charges existing dispersively. Therefore, the influences on the addressing discharge in the next sub-field can be eliminated, and high contrast driving can be executed stably.

According to the typical embodiments of the present invention, in the fourth place, the auxiliary erase pulse is applied in an opposite polarity to that of the voltage pulse higher than the discharge start voltage in order to completely eliminate the residual charges in consideration of the fact that the residual charges by the self-erase discharge is the negative wall charges to the sustain electrode and the positive wall charges to the scan electrode. In consequence, the erase voltage becomes higher than the discharge start voltage in the cells in which the wall charges remain and the erase discharge can be executed, so that high contrast driving can be made stably.

According to the typical embodiments of the present invention, in the fifth place, the auxiliary erase pulse is applied in the same polarity as that of the voltage pulse higher than the discharge start voltage to separate electrodes from those electrodes to which the voltage pulse higher than the discharge start voltage is applied, in order to eliminate the residual charges in consideration of the fact that the residual charge by the self erase discharge is the negative wall charges to the sustain electrodes and the positive wall changes to the scan electrodes. In consequence, the voltage is applied between the electrodes in the same way as in the fourth effect of the typical embodiments described above, and the erase discharge can be made, so that high contrast driving can be executed stably.

According to the typical embodiments of the present invention, in the sixth place, the voltage higher than the discharge start voltage can be applied between the electrodes if the voltage pulse higher than the discharge start voltage is applied to either one of the sustain electrode and the scan electrode. Therefore, the erase discharge can be effected and high contrast driving can be made stably.

According to the typical embodiments of the present invention, in the seventh place, the voltage pulses higher than the discharge start voltage are applied simultaneously and in this way, the erase discharge can be executed simultaneously in the respective display lines. For this reason, the reset process can be conducted within a shorter time.

According to the typical embodiments of the present invention, in the eighth place, the first sustain voltage pulse having a width larger than the ordinary sustain discharge pulse is applied before the application of the voltage pulse higher than the discharge start voltage so as to attract the wall charges of the cells that have executed the sustain discharge. In consequence, the erase discharge can be made reliably and high contrast driving can be made stably.

According to the typical embodiments of the present invention, in the ninth place, the second sustain voltage pulse equivalent to the ordinary sustain discharge pulse is applied for every other display line between the sustain discharge period and the first sustain voltage pulse which is applied before the application of the reset discharge pulse having a voltage higher than the discharge start voltage, so as to align the number of discharges of the sustain discharge pulses in each display line and to align the polarity of the wall charges after the sustain discharge period. Accordingly, the erase discharge by the voltage pulse higher than the discharge start voltage can be made reliably after the finish of the sustain discharge period and high contrast driving can be made stably.

According to the typical embodiments of the present invention, in the tenth place, when the fields are switched over to each other, the similar discharge is effected for the cells that have conducted the display in the fields before the switch-over of the fields, for those cells which are to execute the display in the fields after the switch-over of the fields, and thereafter the sustain discharge pulse is applied in the opposite polarity to that of the whole surface write pulse and for the period larger than the pulse width of the sustain discharge pulse (so as to attract the residual charges). In this way, the reset discharge and the display discharge can be executed stably after the switch-over of the fields.

According to the typical embodiments of the present invention, in the eleventh place, the reset process after the switch-over of the fields is conducted at separate timings for the odd-numbered rows and the even-numbered rows. Therefore, the reset discharge and the display discharge after the switch-over of the fields can be made stably.

According to the typical embodiments of the present invention, in the twelfth place, the driving voltage waveform that can provide the first to eleventh effects of the typical embodiments described above can be accomplished easily.

What is claimed is:

1. A method for driving a plasma display panel comprising a plurality of sustain electrodes and a plurality of scan electrodes disposed in parallel with each other on a substrate for each display line; a plurality of addressing electrodes isolated electrically from said sustain electrodes and said scan electrodes and disposed so as to cross said sustain electrodes and said scan electrodes; and discharge cells formed in areas in which said addressing electrodes cross said sustain electrodes and said scan electrodes;

said method including:

odd-numbered fields for carrying out display between odd-numbered sustain electrodes and odd-numbered scan electrodes and between even-numbered sustain electrodes and even-numbered scan electrodes;

even-numbered fields for carrying out display between said odd-numbered sustain electrodes and said even-numbered scan electrodes and between said even-numbered sustain electrodes and said odd-numbered scan electrodes;

each of said odd-numbered and even-numbered fields including:

a reset period for applying a predetermined voltage to said sustain electrode, said scan electrode and said addressing electrode and executing a reset discharge in a plurality of said discharge cells in order to make uniform a charge distribution among a plurality of said discharge cells;

an addressing period for executing a write discharge between said scan electrode and said addressing electrode in a selected one of said discharge cells and executing a selective write operation in accordance with display data; and a sustain discharge period for applying alternately a sustain discharge pulse to said sustain electrode and said scan electrode in order to repeatedly execute discharge light emission for displaying the display data in said discharge cell in which the selective write operation is executed in said addressing period;

wherein a reset discharge pulse having a voltage higher than a discharge start voltage necessary for starting said reset discharge is applied in said reset period to said sustain electrode and said scan electrode for the period in which the discharge is started in only said discharge cell that has executed said sustain discharge and said discharge cells adjacent to the former discharge cell, and then a potential difference between said sustain electrode and said scan electrode is made substantially zero so that an erase discharge is done for at least said cell that has executed said sustain discharge.

2. A method according to claim 1, wherein the time for applying said reset discharge pulse having a voltage higher than said discharge start voltage is set to a value not larger than 2 $\mu$s.

3. A method according to claim 1, wherein an auxiliary erase pulse having a gentle slope is applied to said sustain electrode or to said scan electrode after the passage of said period in which the potential difference between said sustain electrode and said scan electrode is made substantially zero.

4. A method according to claim 3, wherein said auxiliary erase pulse is a pulse having a polarity opposite to that of said reset discharge pulse having a voltage higher than said discharge start voltage.

5. A method according to claim 3, wherein said auxiliary erase pulse is a pulse having the same polarity as that of said pulse having a voltage higher than said discharge start voltage, and is applied to said sustain electrode or said scan electrode different from said electrode to which said reset discharge pulse having a voltage higher than said discharge start voltage is applied.

6. A method according to claim 3, wherein said reset discharge pulse having a voltage higher than said discharge start voltage is applied to either one of said sustain electrode and said scan electrode.

7. A method according to claim 6, wherein said reset discharge pulses having a voltage higher than said discharge start voltage are applied at the same timing.

8. A method according to claim 1, wherein a first sustain voltage pulse having an opposite polarity to that of said reset discharge pulse having a voltage higher than said discharge start voltage and having a width larger than that of said sustain discharge pulse is applied before said reset discharge pulse having a voltage higher than said discharge start voltage is applied.

9. A method according to claim 8, wherein a second sustain voltage pulse having a width larger than that of said sustain discharge pulse is applied for every other display line between said sustain discharge period and said first sustain voltage pulse applied before the application of said reset discharge pulse having a voltage higher than said discharge start voltage.

10. A method for driving a plasma display panel comprising a plurality of sustain electrodes and a plurality of scan electrodes disposed in parallel with each other on a substrate, associated sustain and scan electrodes defining respective display lines and a plurality of addressing electrodes isolated electrically from said sustain electrodes and said scan electrodes and disposed so as to cross said sustain electrodes and said scan electrodes and to define corresponding discharge cells in areas in which said addressing electrodes cross said sustain electrodes and said scan electrodes, said driving method employing:

odd-numbered fields for carrying out a display between odd-numbered sustain electrodes and odd-numbered scan electrodes and between even-numbered sustain electrodes and even-numbered scan electrodes;

even-numbered fields for carrying out a display between said odd-numbered sustain electrodes and said even-numbered scan electrodes and between said even-numbered sustain electrodes and said odd-numbered scan electrodes;

each of said odd-numbered and even-numbered fields including:

a reset period in which a predetermined voltage is applied to said sustain electrode, said scan electrode and said addressing electrode to execute a reset discharge in each of a plurality of said discharge cells, an addressing period in which a write discharge is executed, in each of selected said discharge cells between respective, said corresponding scan and addressing electrodes, and a sustain discharge period in which a sustain discharge pulse is alternately applied to said sustain electrodes and said scan electrodes in order to repeatedly execute discharge light emission for displaying the display data in said discharge cells in which the selective write operation was performed in said addressing period; addressing periods;

wherein said driving method comprises:

when switching between said odd-numbered and even-numbered fields, performing a reset process so that a whole surface write discharge is executed by applying a reset discharge pulse, having a voltage higher than a discharge start voltage, to each pair of a sustain electrode and a scan electrode that has executed, or is to execute, a sustain discharge, and a self erase discharge is executed at the point of time in which said reset discharge pulse, having a voltage higher than said discharge start voltage, is terminated; and executing another reset process so that a voltage, having an opposite polarity so that of said voltage of said whole surface write discharge and approximately the same voltage level as a voltage level of said sustain discharge pulse, is applied for a period longer than the width of said sustain discharge pulse and, furthermore. applying said reset discharge pulse, having a voltage higher than said discharges start voltage, to the pair of said sustain electrode and said scan electrode that is to execute said sustain discharge in a next one of said odd-numbered field or even-numbered field to thereby execute said whole surface write discharge, and executing said self erase discharge at the point of time in which said reset discharge pulse, having a voltage higher than said discharge start voltage, is terminated.

11. A method according to claim 10, wherein, after said reset process is executed for the pair of said sustain electrode and said scan electrode for either one of said odd-numbered and even-numbered display lines among the pairs of said sustain electrodes and said scan electrodes that have executed, or are to execute, said sustain discharge, said reset process is executed for the other pair of said sustain electrode and said scan electrode;

said voltage having the opposite polarity to that of said whole surface write discharge in said reset process and approximate to the voltage of said sustain discharge pulse is applied for a period at least equal to the pulse width of said sustain discharge pulse; and said reset process is further applied to the pair of said sustain electrode and said scan electrode of either one of said odd-numbered and even-numbered fields, and then said reset process is executed for the other pair of said sustain electrode and said scan electrode.

12. An apparatus for driving a plasma display panel comprising a plurality of sustain electrodes and a plurality of scan electrodes disposed for each display line in parallel with each other on a substrate; a plurality of addressing electrodes isolated electrically from said sustain electrodes and said scan electrodes, and disposed so as to cross said sustain electrodes and said scan electrodes; and discharge cells formed in areas in which said addressing electrodes cross said sustain electrodes and said scan electrodes, respectively;

said apparatus comprising:

odd-numbered fields for carrying out display between odd-numbered sustain electrodes and odd-numbered scan electrodes and between even-numbered sustain electrodes and even-numbered scan electrodes, respectively; and even-numbered fields for carrying out display between said odd-numbered sustain electrodes and said even-numbered electrodes and between said even-numbered sustain electrodes and said odd-numbered scan electrodes, respectively;

each of said odd-numbered and even-numbered fields including a reset period for executing a reset discharge inside a plurality of said discharge cells by applying a predetermined voltage to said sustain electrodes, said scan electrodes and said addressing electrodes in order to make uniform a charge distribution among a plurality of said discharge cells;

an addressing period in which a write discharge is executed between said scan electrode and said addressing electrode in a selected one of said discharge cells, and executing a selective write operation;

a sustain discharge period in which a sustain discharge pulse is alternately applied to said sustain electrode and said scan electrode in order to repeatedly execute discharge light emission for displaying display data in said discharge cell in which the selective write operation is effected in said addressing period;

driving means for supplying a reset discharge pulse for effecting said reset discharge, an addressing pulse for effecting said write discharge and a sustain discharge pulse for effecting said sustain discharge to said sustain electrode, said scan electrode and said addressing electrode; and control means for controlling the sequence for supplying said reset discharge pulse, said addressing pulse and said sustain discharge pulse;

said control means applying a reset discharge pulse having a voltage higher than a discharge start voltage necessary for starting said reset discharge to said sustain electrode or said scan electrode in said reset period for a period of time in which the discharge is started in only said discharge cell that has executed said sustain discharge and said discharge cells adjacent to said discharge cell that has executed said sustain discharge, and in this way, making a potential difference between said sustain electrode and said scan electrode substantially zero, so that an erase discharge is executed for at least said cell that has executed said sustain discharge.

13. An apparatus for driving a plasma display panel comprising a plurality of sustain electrodes and a plurality of scan electrodes disposed for each display line in parallel with each other on a substrate; a plurality of addressing electrodes isolated electrically from said sustain electrodes and said scan electrodes and disposed so as to cross said sustain electrodes and said scan electrodes; and discharge cells formed in areas in which said addressing electrodes cross said sustain electrodes and said scan electrodes, respectively;

said apparatus comprising:

odd-numbered fields for carrying out display between odd-numbered sustain electrodes and odd-numbered scan electrodes and between even-numbered sustain electrodes and even-numbered scan electrodes, respectively; and even-numbered fields for carrying out display between said odd-numbered sustain electrodes and said even-numbered electrodes and between said even-numbered sustain electrodes and said odd-numbered scan electrodes, respectively;

each of said odd-numbered and even-numbered fields including a reset period for executing a reset discharge inside a plurality of said discharge cells by applying a predetermined voltage to said sustain electrode, said scan electrode and said addressing electrode in order to make uniform a charge distribution among a plurality of said discharge cells;

an addressing period in which a write discharge is executed between said sustain electrode and said addressing electrode in a selected one of said discharge cells, and executing a selective write operation; and a sustain discharge period in which a sustain discharge pulse is alternately applied to said sustain electrode and said scan electrode in order to repeatedly execute discharge light emission for displaying display data in said discharge cell in which the selective write operation is effected in said addressing period;

driving means for supplying a reset discharge pulse for effecting said reset discharge, an addressing pulse for effecting said write discharge and a sustain discharge pulse for effecting said sustain discharge to said sustain electrode, said scan electrode and said addressing electrode; and control means for controlling the sequence for supplying said reset discharge pulse, said addressing pulse and said sustain discharge pulse;

wherein, when said odd-numbered field and said even-numbered field are switched over to each other, said control means executes a control so that the whole surface write discharge is executed by applying a reset discharge pulse having a voltage higher than said discharge start voltage in the pair of said sustain electrode and said scan electrode that has executed, or is to execute, said sustain discharge, a self erase discharge is executed at the point of time in which said reset discharge pulse having a voltage higher than said discharge start voltage is eliminated, and a voltage having a polarity opposite to that of the voltage of said whole surface write discharge and approximate to the voltage of said sustain discharge pulse is applied for a period at least equal to the width of said sustain discharge pulse; and in the next odd-numbered field or the even-numbered field, said control means executes a control so that the whole surface write discharge is executed in the pair of said sustain voltage and said scan electrode by applying said reset discharge pulse having a voltage higher than said discharge start voltage, and said self-erase discharge is executed at the point of time in which said reset discharge pulse having a voltage higher than said discharge start voltage is eliminated.

14. A method for driving a plasma display panel comprising:

applying a reset discharge pulse, having a voltage higher than a discharge start voltage necessary for starting a reset discharge, for a period in which a discharge is started, only in each of first discharge cells that have undergone a sustain discharge and second discharge cells adjacent to the first discharge cells.

15. A method according to claim 14, further comprising:

setting a time for applying said reset discharge pulse, having a voltage higher than said discharge start voltage, to a value not larger than 2 $\mu$s.

16. A method according to claim 14, wherein the sustain discharge is produced by applying a sustain discharge pulse, alternately, to sustain electrodes and scan electrodes, thereby repeatedly executing discharge light emissions for displaying display data in the selected discharge cells in which a selective write operation was executed in an addressing period, further comprising:

applying an auxiliary erase pulse having a gentle slop to said sustain electrodes or to said scan electrodes, after passage of a period in which a potential difference between the sustain electrode and the scan electrode of each selected discharge cell has reduced substantially to zero.

17. A method according to claim 16, wherein the auxiliary erase pulse has a polarity opposite to a polarity of the reset discharge pulse having a voltage higher than the discharge start voltage.

18. A method according to claim 16, wherein the auxiliary erase pulse has the same polarity as that of the pulse having a voltage higher than the discharge start voltage and is applied to the one of the sustain electrode and the scan electrode which is different from the one electrode thereof to which the reset discharge pulse, having a voltage higher than the discharge start voltage, is applied.

19. A method according to claim 16, wherein the reset discharge pulse, having a voltage higher than the discharge start voltage, is applied to one of the sustain electrode and the scan electrode related to a discharge cell which executed a sustain discharge.

20. A method according to claim 19, wherein the reset discharge pulses, each having a voltage higher than the discharge start voltage, are applied at a common timing.

21. A method according to claim 14, wherein a first sustain voltage pulse, having an opposite polarity to that of the reset discharge pulse having a voltage higher than the discharge start voltage and having a width larger than that of the sustain discharge pulse, is

22. A method according to claim 21, wherein a second sustain voltage pulse, having a width larger than than that of the sustain discharge pulse, is applied for every other display line between a sustain discharge period and the sustain voltage pulse applied before the application of the reset discharge pulse having a voltage higher than said discharge start voltage.

23. A method of driving a plasma display panel in an interlaced scan, switching between odd-numbered and even-numbered fields, comprising:

at each switching between odd-numbered and even-numbered fields, executing a reset process to perform a whole surface write discharge by applying a reset discharge pulse, having a voltage higher than a discharge start voltage, to each pair of sustain and scan electrodes associated with a discharge cell which has executed, or is to execute, a sustain discharge, a self erase discharge being executed at a point in time at which the reset discharge pulse, having a voltage higher than the discharge start voltage, terminates; and in a next successive and alternate one of the odd-numbered and even-numbered fields, executing a corresponding reset process, employing a reset discharge pulse of common voltage but opposite polarity to that of the reset pulse in the preceding, first one of the odd-numbered and even-numbered fields and correspondingly producing a voltage of opposite polarity of the whole surface write discharge.

24. A method for driving a plasma display panel having plural, parallel display lines, each line comprising plural discharge cells and each discharge cell being defined by a corresponding address electrode, spaced from and crossing a corresponding pair of parallel sustain and scan electrodes, each display frame comprising successive, odd-numbered and even-numbered fields, the method comprising:

defining, in each of the odd-numbered and even-numbered fields, a reset period in which a reset discharge is executed, an addressing period in which a selective write operation is performed in selected discharge cells in accordance with display data and a sustain discharge period in which sustain discharge pulses are alternately applied to the sustain and scan electrodes to repeatedly execute discharge light emission for displaying the display data, in each of corresponding discharge cells in which a selective write operation was performed in the addressing period; and when switching between odd-numbered and even-numbered fields:

executing a first reset process, and thereby producing a first whole surface write discharge, by applying a first reset discharge pulse having a first voltage higher than a discharge start voltage, to each pair of sustain and scan electrodes relating to a discharge cell which has executed or is to execute a sustain discharge, and thereby executing a first self erase discharge in the discharge cell at a point in time in which the first reset discharge pulse terminates, and executing a second reset process, by applying a voltage having an opposite polarity to that of the voltage of the first whole surface write discharge and approximately the same as the voltage of the sustain discharge pulse, for a period longer than the width of the sustain discharge pulse and wherein a second reset discharge pulse has a second voltage higher than the discharge start voltage, is applied to each pair of sustain and scan electrodes which is to execute a sustain discharge in a next one of the odd- or even-numbered fields, thereby to executed a second whole surface write discharge and therey executing a second self erase discharge at a point in time in which the second reset discharge pulse, having the second voltage higher than the discharge start voltage, terminates.

25. An apparatus driving a plasma display panel, comprising:

a driving circuit applying a reset discharge pulse, having a voltage higher than a discharge start voltage necessary for starting a reset discharge, for a period in which a discharge is started, only in each of first discharge cells that have undergone a sustain discharge and second discharge cells adjacent to the first discharge cells.

26. An apparatus according to claim 25, further comprising:

a timing circuit setting a time for applying said reset discharge pulse, having a voltage higher than said discharge start voltage, to a value not larger than 2 $\mu$s.

27. An apparatus according to claim 25, wherein:

the driving circuit produces the sustain discharge by applying a sustain discharge pulse, alternately, to sustain electrodes and scan electrodes thereby repeatedly executing discharge light emissions for displaying display data in selected discharge cells in which a selective write operation was executed in an addressing period and, further, applies an auxiliary erase pulse having a gentle slop to said sustain electrode or to said scan electrode after passage of a period in which a potential difference between the sustain electrode and the scan electrode has reduced substantially to zero.

28. An apparatus according to claim 27, wherein:

the driving circuit applies the auxiliary erase pulse in a polarity opposite to a polarity of the reset discharge pulse having a voltage higher than the discharge start voltage.

29. An apparatus according to claim 27, wherein:

the driving circuit applies the auxiliary erase pulse, in the same polarity as that of the pulse having a voltage higher than the discharge start voltage, to the one of the sustain electrode or the scan electrode which is different from the one electrode thereof to which the reset discharge pulse, having a voltage higher than the discharge start voltage, is applied.

30. An apparatus according to claim 27, wheren:

the driving circuit applies the reset discharge pulse, having a voltage higher than the discharge start voltage, to one of the sustain electrode and the scan electrode of a discharge cell which executed a sustain discharge.

31. An apparatus according to claim 27, wherein:

the driving circuit applies the reset discharge pulses, each having a voltage higher than the discharge start voltage, at a common timing.

32. An apparatus according to claim 27, wherein: the driving circuit applies a first sustain voltage pulse, having an opposite polarity to that of the reset discharge pulse having a voltage higher than the discharge start voltage and having a width larger than that of the sustain discharge pulse, before applying the reset discharge pulse having a voltage higher than the discharge start voltage.

33. An apparatus according to claim 32, wherein:

the driving circuit applies a second sustain voltage pulse, having a width larger than that of the sustain discharge pulse, for every other display line between sustain discharge period and the first sustain voltage pulse applied before the application of the reset discharge pulse having a voltage higher than said discharge start voltage.

34. An apparatus for driving a plasma display panel having plural, parallel display lines, each line comprising plural discharge cells and each discharge cell being defined by a corresponding address electrode, spaced from and crossing a corresponding pair of parallel sustain and scan electrodes, each display frame comprising successive, odd-numbered and even-numbered fields, the apparatus comprising:

a controller defining, in each of the odd-numbered and even-numbered fields, a reset period in which a reset discharge is executed in each thereof, an addressing period in which a selected write operation is performed in selected discharge cells in accordance with display data and a sustain discharge period in which sustain discharge pulses are alternately applied to the sustain and scan electrodes to repeatedly execute discharge light emission for displaying the display data, in each of corresponding discharge cells in which a selective write operation was performed in the addressing period and controlling switching between odd-numbered and even numbered fields; and a driving circuit, in response to the switching:

executing a first reset process, and thereby producing a first whole surface write discharge, by applying a first reset discharge pulse having a first voltage higher than a discharge start voltage, to each pair of sustain and scan electrodes relating to a discharge cell which has executed or is to execute a sustain discharge, and thereby executing a first self erase discharge cell at a point in time in which the first reset discharge pulse terminates; and executing a second reset process by applying a voltage having an opposite polarity to that of the voltage of the first whole surface write discharge and approximately the same as the voltage of the sustain dicharge pulse, for a period longer than the width of the sustain discharge pulde, and wherein a second reset discharge pulse has a second voltage higher than the discharge start voltage, is applied to each pair of sustain and scan electrodes which to execute a sustain discharge in a next one of the odd- or even-numbered fields, thereby to execute a second whole surface write discharge and thereby executing a second self erase discharge at a point in time in which the second reset discharge pulse, having the second voltage higher than the discharge start voltage, terminates.

* * * * *